US005168014A

United States Patent [19]

Daimaru et al.

[11] Patent Number: 5,168,014

[45] Date of Patent: Dec. 1, 1992

[54] SILICON CARBIDE-REINFORCED LIGHT ALLOY COMPOSITE MATERIAL

[75] Inventors: Akimasa Daimaru; Tohru Ohta; Tatsuya Suzuki; Masao Ichikawa; Hirotaka Koshitani; Hideyuki Fujishiro, all of Saitama, Japan

[73] Assignee: Honda Giken Kogyo Kabushiki Kaisha, Tokyo, Japan

[21] Appl. No.: 425,729

[22] Filed: Oct. 23, 1989

[30] Foreign Application Priority Data

| | | | |
|---|---|---|---|
| Oct. 21, 1988 | [JP] | Japan | 63-265894 |
| Oct. 21, 1988 | [JP] | Japan | 63-265895 |
| Oct. 31, 1988 | [JP] | Japan | 63-275507 |
| Oct. 31, 1988 | [JP] | Japan | 63-275508 |
| Oct. 31, 1988 | [JP] | Japan | 63-275509 |
| Oct. 31, 1988 | [JP] | Japan | 63-275510 |
| Oct. 31, 1988 | [JP] | Japan | 63-275511 |
| Nov. 2, 1988 | [JP] | Japan | 63-278079 |

[51] Int. Cl.[5] ..... B32B 15/04

[52] U.S. Cl. ..... 428/627; 106/482; 423/345; 423/440; 428/539.5; 428/650

[58] Field of Search ..... 428/627, 650, 539.5; 423/345, 440; 106/482

[56] References Cited

U.S. PATENT DOCUMENTS

| | | | |
|---|---|---|---|
| 3,653,851 | 4/1972 | Gruber | 428/539.5 |
| 4,507,224 | 3/1985 | Toibana | 428/627 |
| 4,544,642 | 10/1985 | Maeda | 428/627 |
| 4,610,934 | 9/1986 | Boecker | 428/627 |
| 4,657,825 | 4/1987 | Kanda | 428/627 |

FOREIGN PATENT DOCUMENTS 0062497 10/1982 European Pat. Off. .

OTHER PUBLICATIONS

Metals Handbook; Magnesium and its Alloys.

*Primary Examiner*—Peter D. Rosenberg
*Attorney, Agent, or Firm*—Lyon & Lyon

[57] ABSTRACT

A silicon carbide-reinforced light alloy composite material comprises a matrix of a light weight alloy and a reinforcing material consisting of at least one of a silicon carbide whisker and a silicon carbide grain. In the composite material, the content of $SiO_2$ contained in the reinforcing material, is set in the range of 0.05 to 5.0% by weight.

43 Claims, 15 Drawing Sheets

0.2% load bearing ability of composite material (kg/mm²)
20
10
0
(1)
(2)
(3)
(4)
b1
b2
0
1
2
3
4
SiO2 content (% by weight)

0.2% load bearing ability of composite material (kg/mm²)
20
10
0
(5)
(6)
(7)
(8)
c1
c2
0
1
2
3
4
SiO2 content (% by weight)

0.2% load bearing ability of composite material (kg/mm²)
20
10
0
(10)
(11)
(9)
(12)
d1
d2
0
1
2
3
4
SiO2 content (% by weight)

SILICON CARBIDE-REINFORCED LIGHT ALLOY COMPOSITE MATERIAL

BACKGROUND OF THE INVENTION

1. Field of the Invention

The field of the present invention is silicon carbide-reinforced light weight alloy composite materials, and more particularly, improvements of composite materials comprising a matrix of a light weight alloy and a reinforcing material consisting of at least one of a silicon carbide whisker and a silicon carbide grain.

2. Description of the Prior Art

There are such conventionally known composite materials made using an Al-Mg based alloy which is an aluminum alloy as a light weight alloy and using a silicon carbide whisker with $SiO_2$ removed as a reinforcing material (see Japanese Patent Application Laid-open No. 538/86).

It is alleged that the reason why $SiO_2$ contained in the silicon carbide is removed in the prior art is because $SiO_2$ may preferentially react with Mg in the Al-Mg based alloy during compounding to produce an intermetallic compound of $Mg_2Si$ which is segregated to cause a reduction in strength of the resulting composite material.

However, the present inventors have made various reviews and as a result, have cleared up the following fact.

If the $SiO_2$ content is zero, the strength of the composite material is reduced, and variation in strength is produced. If the $SiO_2$ content is of a predetermined value, a compounding effect appears. If the $SiO_2$ exceeds the predetermined value, the compounding effect is lost. These phenomena may be produced even when an Al-Cu based alloy or an Al-Si based alloy is used as a matrix.

When these respects are taken into consideration, it can be safely said that the strength of the composite material is governed not only by the reaction of Mg in the matrix with $SiO_2$ and the like, but also by the content of $SiO_2$ and the like contained in the silicon carbide whisker.

It is also known to use an aluminum alloy containing Mg and Cu in order to improve the strength characteristic of the composite material (for example, see Japanese Patent Application Laid-open Nos. 279647/86 and 199740/87).

However, there is the following problem: When a composite material is produced using such aluminum alloy by utilizing a pressure casting process, cracks may be produced in a molded product and thus, a composite material for a practical use cannot be provided, because the filling of a molten metal into a reinforcing molded product made of a silicon carbide whisker or the like cannot be smoothly conducted.

Further, it is known to use a casting Al-Si based alloy as the aforesaid aluminum alloy. An eutectic crystal silicon in this Al-Si based alloy precipitates in the form of a needle crystal to cause a reduction in toughness of a matrix. For this reason, one element selected from Sb, Na and Sr is added to a molten metal during casting to effect an improving treatment of such alloy in order to provide a spherical eutectic crystal silicon.

When such improving treatment is conducted, the toughness of a simple Al-Si base alloy material is improved, on the one hand, and the tensile strength thereof is reduced, on the other hand. With a composite material made using this Al-Si based alloy as a matrix, a problem of reductions in both of toughness and tensile strength arises.

Furthermore, when the intermetallic compound of $Mg_2Si$ is produced as described above, it promotes wearing of a tool during cutting of the resulting composite material and reduces the life of the tool, because the intermetallic compound has a high hardness. A cutting mechanism for the composite material cuts the matrix while falling off the reinforcing material such as the silicon carbide whisker and the like from the matrix by the tool, but when the aforesaid compound is in close contact with the reinforcing material, it exhibits an anchoring effect of retaining the reinforcing material in the matrix, resulting in a problem that not only the life of the tool is shortened, but also the cutting efficiency is reduced.

With such a composite material, when an improvement in wear resistance thereof is intended to be provided, it is a common practice to enhance the volume fraction (Vf) of the silicon carbide whisker.

There is spontaneously a limit for the enhancement of the volume fraction as described above when the falling property of a molten metal is taken into consideration. In addition, the cost of the composite material is increased with an increase in content of the silicon carbide whisker.

Further, there are such composite materials made using as a light weight alloy, Mg-Al based and Mg-Al-Zn based alloys which are magnesium alloys.

However, such magnesium alloys have a problem that they are poor in wettability to the silicon carbide whisker and the like, thereby providing a lower interfacial bond strength between the silicon carbide whisker and the matrix is lower, with the result that a sufficient reinforcing power of the silicon carbide whisker and the like is not obtained in the resulting composite material. Another problem is that an intermetallic compound of $Mg_2Si$ is produced by reaction of $SiO_2$ and Mg, as describe above.

Yet further, it is considered that the wear resistance of such a composite material depends upon the matrix. For this reason, a wear resistant magnesium alloy having a smaller content of the aforesaid corrosion promoting constituents is employed.

Even if a wear resistant magnesium alloy as described above is employed, however, the following problem arises: If the corrosion promoting constituents are contained in a content exceeding a predetermined level in the reinforcing material, an electrolytic corrosion occurring between the corrosion promoting constituents and the matrix is activated in a corrosive environ-ment due to the fact that the corrosion promoting constituents are difficult to solid-solubilize in the wear resistant magnesium alloy. As a result, the wear resistance of the resulting composite material is substantially degraded.

SUMMARY OF THE INVENTION

It is an object of the present invention to provide a composite material of the type described above, wherein the strength thereof is improved and the variation in strength is reduced by specifying the content of $SiO_2$ contained in a silicon carbide whisker or a silicon carbide grain.

It is another object of the present invention to provide a composite material of the type described above, which is produced in such a manner that the filling of a molten metal into a reinforcing molded product made of a silicon carbide or the like is smoothly conducted, so that cracking of the molded product may be avoided.

It is a further object of the present invention to provide a composite material of the type described above, which has excellent tensile strength and toughness provided by preventing the needling and coalescence of an eutectic crystal silicon in an Al-Si based alloy which is not subjected to an improving treatment.

It is a yet further object of the present invention to provide a composite material of the type described above, which has a cuttability improved by suppressing the production of an intermetallic compound of $Mg_2Si$ by specifying the relationship between the content of $SiO_2$ contained in a silicon carbide whisker and the Mg content in an aluminum alloy.

Further, it is an object of the present invention to provide a composite material of the type described above, which is relatively inexpensive in cost and has a wear resistance improved by utilizing a silicon carbide whisker aggregate which is usually removed at a step of opening of the silicon carbide whisker.

It is another object of the present invention to provide a composite material of the type described above, wherein the wettability between a silicon carbide whisker or the like and a magnesium alloy is improved.

It is a further object of the present invention to provide a composite material of the type described above, which has an excellent corrosion resistance, wherein the electrolytic corrosion occurring between corrosion promoting constituents and a matrix can be substantially suppressed.

To achieve the above objects, according to the present invention, there is provided a silicon carbide-reinforced light weight alloy composite material comprising a matrix of a light weight alloy and a reinforcing material consisting of at least one of a silicon carbide whisker and a silicon carbide grain, wherein the content of $SiO_2$ contained in the reinforcing material is set in the range of 0.05 to 5.0% by weight. As used herein in connection with the present invention, the term "light weight alloy" includes aluminum and magnesium alloys, but it is not necessarily limited thereto unless the text so indicates.

In addition, according to the present invention, there is provided a silicon carbide-reinforced light weight alloy composite material, wherein the light weight alloy is an aluminum alloy which comprises 4.0 to 7.0% by weight of Si, 2.0 to 4.0% by weight of Cu, 0.25 to 0.5% by weight of Mg and the balance of Al.

Further, according to the present invention, there is provided a silicon carbide-reinforced light weight alloy composite material, wherein the light weight alloy is an aluminum alloy which is an Al-Si based alloy which is not subjected to an improving treatment.

Yet further, according to the present invention, there is provided a silicon carbide-reinforced light weight alloy composite material, wherein the light weight alloy is an aluminum alloy which is an Al-Si based alloy subjected to an improving treatment by adding one element selected from Sb, Na and Sr, with the amount of Sb added being set at less than 0.07% by weight, the amount of Na added being set at less than 10 ppm, and the amount of Sr added being set at less than 0.03% by weight.

Further, according to the present invention, there is provided a silicon carbide-reinforced light weight alloy composite material comprising a matrix of light weight alloy and a reinforcing material consisting of at least one of a silicon carbide whisker and a silicon carbide grain, wherein the reinforcing material contains $SiO_2$, and the light weight alloy is an aluminum alloy containing Mg, with the content of $SiO_2$ in the reinforcing material and the Mg content in the aluminum alloy being set as coordinates lined in a region (but the Mg content equal to zero is excluded) surrounded by a closed line, which connects four coordinates (0.05% by weight, 0), (5.0% by weight, 0), (5.0% by weight, 0.3% by weight), and (0.05% by weight, 0.5% by weight) where in that order, in a graph $SiO_2$ content (% by weight) is represented by an abscissa, and the Mg content (% by weight) is by an ordinate.

Further, according to the present invention, there is provided a silicon carbide-reinforced light weight alloy composite material comprising a silicon carbide whisker as a reinforcing material, wherein it contains a substantially spherical silicon carbide whisker aggregate having a volume fraction higher than the volume fraction (Vf) of the silicon carbide whisker, with the diameter of the silicon carbide whisker aggregate being set at 100 μm or less and the content of the silicon carbide whisker aggregate based on the silicon carbide whisker being set in the range of 0.2 to 5.0% by volume.

Further, according to the present invention, there is provided a silicon carbide-reinforced light weight alloy composite material, wherein the light alloy is a magnesium alloy which contains 0.1 to 1.0% by weight of Ca.

Further, according to the present invention, there is provided a silicon carbide-reinforced light weight alloy composite material, wherein the content of Ca in the magnesium alloy is set as defined above, and the content of $SiO_2$ is set in the range of 0.8 to 5.0% by weight.

Yet further, according to the present invention, there is provided a silicon carbide-reinforced light weight alloy composite material, wherein the light weight alloy is a magnesium alloy, and the content of $SiO_2$ in the silicon carbide whisker is in the range of 1.0 to 5.0% by weight.

Yet further, according to the present invention, there is provided a silicon carbide-reinforced light weight alloy composite material, wherein the light weight alloy is a magnesium alloy, and the reinforcing material contains one element selected from Fe, Cu, Ni and Co as corrosion promoting constituents which hinder the corrosion resistance of the magnesium alloy, with the content of that corrosion promoting constituent being set at 0.3% by weight or less.

Yet further, according to the present invention, there is provided a silicon carbide-reinforced light weight alloy composite material, wherein the light weight alloy is a magnesium alloy, and the reinforcing material contains two or more elements selected from Fe, Cu, Ni and Co as corrosion promoting constituents which hinder the corrosion resistance of the magnesium alloy, with the total content of those corrosion promoting constituents being set at 0.3% by weight or less.

If the $SiO_2$ content is set as defined above, it is possible to provide a composite material wherein the strength of the silicon carbide whisker is maintained and moreover, the wettability of the light weight alloy matrix with the silicon carbide whisker is improved, thereby enhancing the strength and reducing the variation in strength.

However, if the $SiO_2$ content is less than 0.05 to 0.1% by weight, a reduction in strength of the composite material and a variation in strength are produced as a result of degradation of the wettability of the silicon carbide whisker with the light weight alloy matrix. On the other hand, if the $SiO_2$ content is more than 4.0 to 5.0% by weight, the $SiO_2$ content is excessive, bringing about a shortage of the strength of the silicon carbide whisker and the like. In addition, the strength of the composite material is reduced, because $SiO_2$ is a starting point for cracking.

If 4.0 to 7.0% by weight of Si is contained in the aluminum alloy matrix as described above, the running property of a molten metal can be improved, so that the molten metal can be smoothly filled into the reinforcing molded product at a pressure casting step, thereby avoiding cracking of the reinforcing molded product. In addition, the reduction in strength, particularly tensile strength of the composite material can be avoided by specifying the Si content as described above.

However, if the Si content is less than 4.0% by weight or more than 7.0% by weight, the reinforcing molded product may crack to bring about a reduction in strength of the composite material.

On the other hand, the strength, particularly the tensile strength and Charpy impact value of the composite material can be improved by specifying the contents of Cu and Mg as described above.

However, if the Cu content is less than 2.0% by weight and if the Mg content is less than 0.25% by weight, the tensile strength of the composite material is reduced. On the other hand, if the Cu content is more than 4.0% by weight and if the Mg content is more than 0.5% by weight, Charpy impact value of the composite material is reduced.

When an Al-Si based alloy which is not subjected to an improving treatment is used as a matrix as described above and if a silicon carbide whisker or the like is present, the needling and coalescence of an eutectic crystal silicon in the Al-Si based alloy can be prevented by the silicon carbide whisker or the like. In this case, there is an advantage in production of a composite material that the Al-Si based alloy may be not subjected to an improving treatment.

In addition, it is possible to provide a composite material having excellent tensile strength and toughness provided by an effect of the silicon carbide whisker or the like and an improving effect of Sb and the like.

For the purpose of the improving treatment, in general, Sb is added in the amount of 0.07 to 0.15% by weight; Na is added in an amount of 10 to 30 ppm, and Sr is added in the amount of 10 0.03 to 0.05% by weight, thereby bringing about reductions in tensile strength and toughness, but the added amounts of Sb and the like in the present invention are less than the aforesaid lower limit values and hence, such a disadvantage does not arise.

If the content of $SiO_2$ in the reinforcing material and the content of Mg in the aluminum alloy are specified as shown by the above-described coordinates, the production of the inter-metallic compound of $Mg_2Si$ is suppressed and consequently, the cuttability of the composite material is improved, and the strength thereof is insured.

In this case, the reason why the $SiO_2$ content is limited to 0.05–5.0% by weight is as described above.

On the other hand, if the Mg content is more than 0.5% by weight, the quantity of such intermetallic compound produced, even if the $SiO_2$ content is set at a lower level, 0.05% by weight, is increased to reduce the resulting composite material. Thus, the upper limit of the Mg content is set at 0.5% by weight.

If the diameter and content of the silicon carbide whisker aggregate are specified as described above, it is possible to provide a relative inexpensive cost composite material having excellent wear resistance and strength.

However, if the content of the silicon carbide whisker aggregate is less than 0.2% by volume, the opening treatment must be conducted for an extended time in order to achieve such a content and hence, the fold loss of the silicon carbide whisker is increased to reduce the fiber reinforcing power, thereby causing a reduction in strength of the resulting composite material. Any content of the silicon carbide whisker aggregate more than 5.0% by volume will result in a reduced wear resistance of the composite material. On the other hand, the diameter of the silicon carbide whisker aggregate is more than 100 μm, the strength of the composite material is reduced.

If Ca is contained in the magnesium alloy as described above, Ca solidifies in a surface of the silicon carbide whisker or the like, causing the magnesium alloy matrix to come into close contact with the silicon carbide whisker or the like through such Ca, thereby improving the wettability therebetween to enhance the interfacial bond strength therebetween. This causes the silicon carbide whisker or the like to exhibit a sufficient reinforcing power and therefore, it is possible to improve the strength of the resulting composite material.

However, if the amount of Ca added is less than 0.1% by weight, the improvement of the wettability is not sufficiently not provided. On the other hand, even if Ca is added in an amount exceeding 1.0% by weight, a corresponding effect can not be obtained.

Additionally, if Ca is contained in the magnesium alloy and the $SiO_2$ content is specified in the range of 0.8 to 5.0% by weight, the strength of the silicon carbide whisker or the like is maintained and moreover, the wettability thereof with the magnesium alloy is further improved. This makes it possible to provide a composite material having an improved strength and a reduced variation in strength.

However, if the $SiO_2$ content is less than 0.8% by weight, the variation in strength of the composite material is increased as a result of degradation of the wettability between the silicon carbide whisker or the like and the magnesium alloy. On the other hand, if the $SiO_2$ content is more than 5.0% by weight, the $SiO_2$ content is excessive, bringing about a shortage of the strength of the silicon carbide whisker or the like, and the strength of the composite material is reduced, because $SiO_2$ is a starting point of cracking.

If the $SiO_2$ content in a silicon carbide whisker is set in the range of 1.0 to 5.0% by weight in a silicon carbide-reinforced light weight alloy composite material comprising a magnesium alloy as a matrix as described above, the binding force between the silicon carbide whisker portions is increased by a binder effect of $SiO_2$, and the wettability of the silicon carbide whisker with the magnesium alloy is improved. This makes it possible to provide a high strength composite material of the type described above.

However, if the $SiO_2$ content is less than 1.0% by weight, the aforesaid effect is difficult to obtain. On the other hand, if the $SiO_2$ content is more than 5.0% by weight, the quantity of $Mg_2Si$ intermetallic compound produced is increased, giving rise to a reduction in strength and a degradation of workability of the resulting composite material.

If the content or total content of one or two or more corrosion promoting constituent or constituents contained in the reinforcing material is specified as described above, an electrolytic corrosion occurring between the corrosion promoting constituent(s) and the magnesium alloy matrix can be substantially suppressed in a corrosive environment, thereby improving the corrosion resistance of the composite material.

However, if the content or total content of the corrosion promoting constituent or constituents is more than 0.3% by weight, the corrosion resistance of the composite material is reduced as a result of activation of such electrolytic corrosion.

The above and other objects, features and advantages of the invention will become apparent from a reading of the following detailed description of the preferred embodiments, taken in conjunction with the accompanying drawings.

BRIEF DESCRIPTION OF THE DRAWINGS

FIG. 10 is a graph illustrating a relationship between the Sb content and the tensile strength of the composite material and the like;

FIG. 11 is a graph illustrating a relationship between the Sb content and Charpy impact value of the composite material and the like;

DESCRIPTION OF THE PREFERRED EMBODIMENTS

Example 1

Four silicon carbide whiskers having contents of $SiO_2$ set respectively at 0%, 0.25%, 1.2% and 4.1% by weight were prepared as a reinforcing material, and molding materials containing the individual silicon carbide whiskers dispersed therein were subjected to a vacuum forming process to provide four reinforcing molded products (1) to (4). The size of each of the reinforcing molded products (1) to (4) was 18 mm long $\times$18 mm wide $\times$70 mm height, and the volume fraction thereof (Vf) was of 15%.

Figure 1:
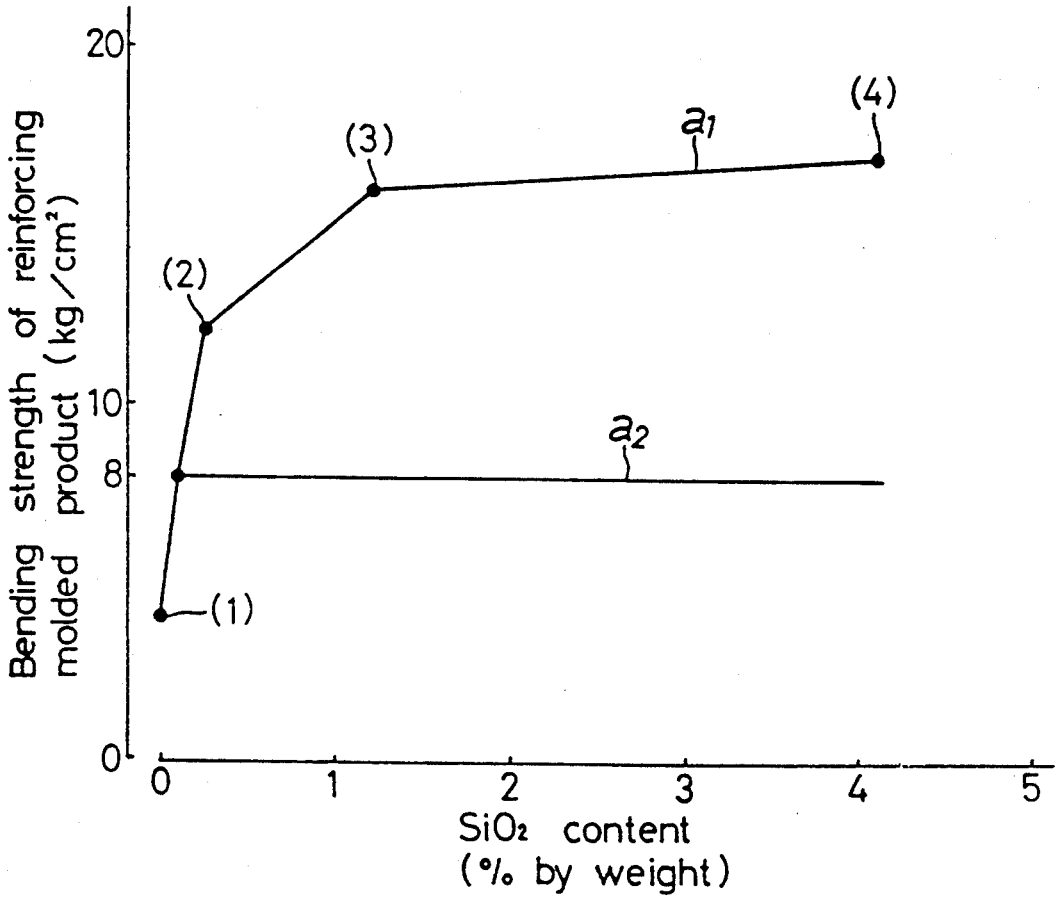
FIG. 1 is a graph illustrating a relationship between the $SiO_2$ content and the strength of a reinforcing molded product.

The reinforcing molded products (1) to (4) were subjected to a bending test to provide results indicated by a line $a_1$ in FIG. 1. This test was conducted in a three-point bending manner wherein a load was applied to the center of each of the reinforcing molded products with a distance between its two fulcrums being of 40 mm.

In this case, the lowest strength required for the reinforcing molded products is of 8 kg/cm$^2$ as indicated by a line $a_2$ in FIG. 1. Therefore, if the content of $SiO_2$ in the silicon carbide whisker is of 0.05% by weight or more, preferably 0.1% by weight or more, a binder effect of $SiO_2$ present in a surface layer of the silicon carbide whisker makes it possible to insure the strength of the reinforcing molded product.

An Al-Cu based alloy containing 4% by weight or less, e.g., 3% by weight in the present embodiment, of Cu, an Al-Mg based alloy containing 1% by weight or less, e.g., 1% by weight in the present embodiment, of Mg and an Al-Si based alloy con-taining 7% by weight or less, e.g., 7% by weight in the present embodiment, of Si, were prepared as an aluminum alloy matrix which is a matrix of a light weight alloy, and a pressure casting process was utilized under conditions of a heating temperature of 700° C. for 15 minutes in a preheating treatment of the reinforcing molded products, a mold temperature of 300° C., a molten metal temperature of 750° C., and a pressing force of 800 kg/cm$^2$ to provide various composite materials. For comparison, a simple material made of a simple alloy alone was produced in a pressure casting under the above conditions.

Figure 2A:
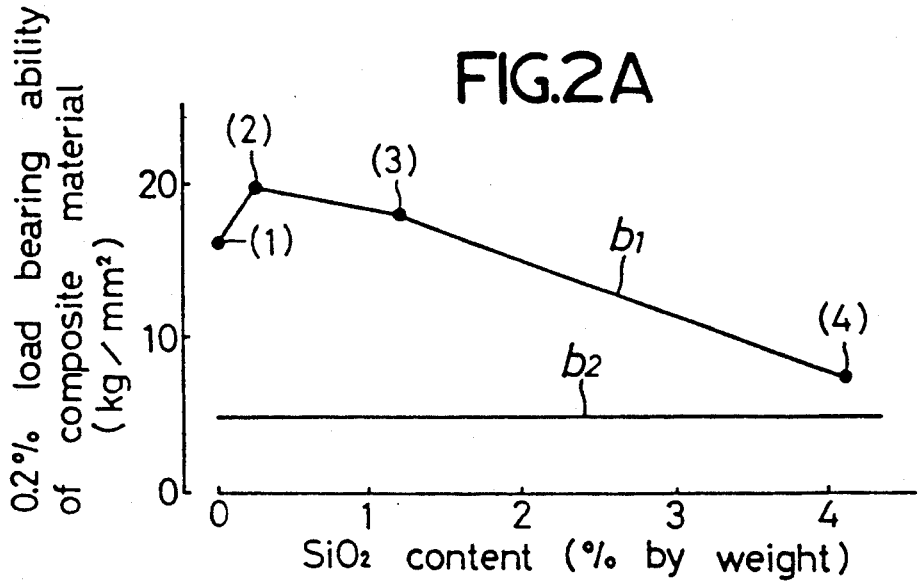
FIGS. 2A to 2C are graphs illustrating a relationship between the $SiO_2$ content and the strength of three composite materials.
Figure 2B:
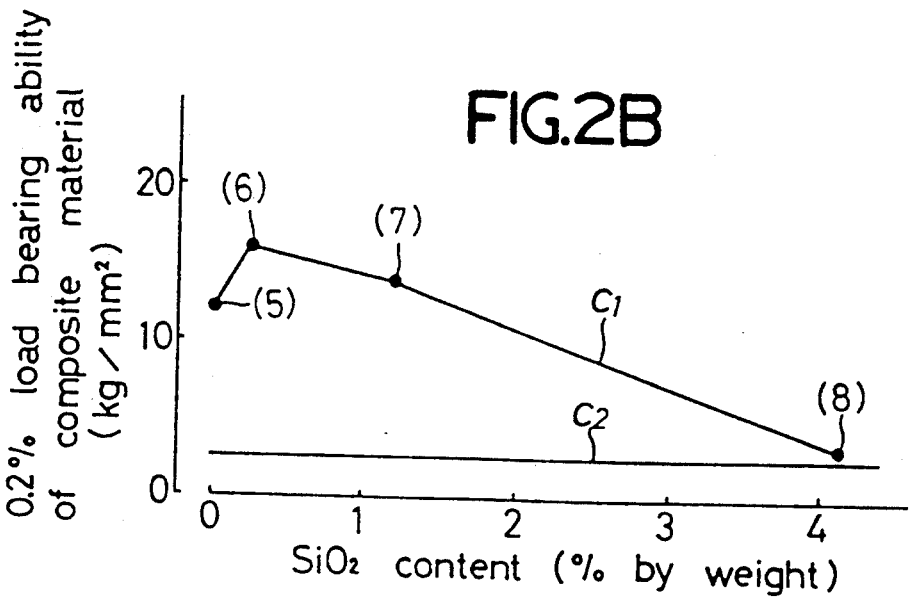
Figure 2C:
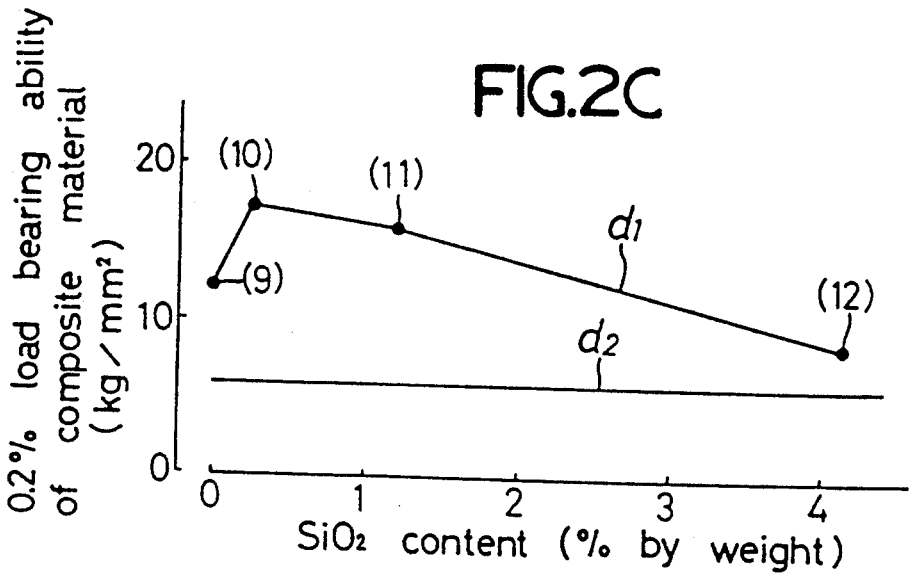

FIGS. 2A to 2C give results of a tensile test for the composite materials. The results are represented by an average value for five test pieces cut off from every composite material.

A line $b_1$ in FIG. 2A corresponds to the composite materials (1) to (4) made using the Al-Cu based alloy as a matrix; a line $c_1$ in FIG. 2B corresponds to the composite materials (5) to (8) made using the Al-Mg based alloy as a matrix, and a line $d_1$ in FIG. 2C corresponds to the composite materials (9) to (12) made using the Al-Si based alloy as a matrix. In addition, straight lines $b_2$ to $d_2$ correspond to the simple materials.

As apparent from FIGS. 2A to 2C, as the content of $SiO_2$ is gradually increased, the strength of the composite material is improved. When the content of $SiO_2$ is of 0.25% by weight, the highest strength of the composite material is obtained. Thereafter, with increasing of the content of $SiO_2$, the strength of the composite material is reduced. If the content is $SiO_2$ is more than 4.0 by weight, the strength of the composite material approximates to that of the simple material, and the composite effect is lost.

Therefore, a suitable content of $SiO_2$ in the silicon carbide whisker is in the range of 0.1 to 4.0% by weight.

As a result of observation of the broken face of each of the composite materials having the content of $SiO_2$ of zero by a scanning electron microscope, it was confirmed that many fine cracks were produced in the reinforcing molded product. This is the cause of reducing the strength of the composite material and generating a large variation in strength thereof.

It is believed that the cracks are caused by the fact that the reinforcing molded product is low in strength because the binder effect is not obtained. It is also supposed that the cracks are caused on the basis of the fact that because $SiO_2$ serves to improve the wettability between the silicon carbide whisker and the aluminum alloy matrix, the elimination of $SiO_2$ causes a rise in the minimum level of the impregnating pressure which is required to make a molten metal penetrate into the reinforcing molded metal.

Example 2

Six silicon carbide whiskers having contents of $SiO_2$ set respectively at 0%, 0.1%, 0.25%, 1.2%, 2.1% and 4.1% by weight were prepared as a reinforcing material, and six reinforcing molded products were produced in the same manner as in Example 1. The size of each of the reinforcing molded products was 18 mm long ×18 mm wide ×70 mm high, and the volume fraction thereof (Vf) was of 15%.

An aluminum alloy matrix (Al-Si-Cu-Mg based alloy made under a trade name of CALYPSO S5R by PECHINEY Co., Ltd., France) was prepared as a matrix of a light weight alloy and a pressure casting process was utilized under conditions of a heating temperature of 700° C. for 15 minutes in a preheating treatment of each of the reinforcing molded products, a mold temperature of 300° C., a molten metal temperature of 750° C. and a pressing force of 800 kg/cm$^2$ as in Example 1 to provide various composite materials (13) to (18). For comparison, a simple material made of the above aluminum alloy alone was produced in a pressure casting under the above conditions.

Figure 3:
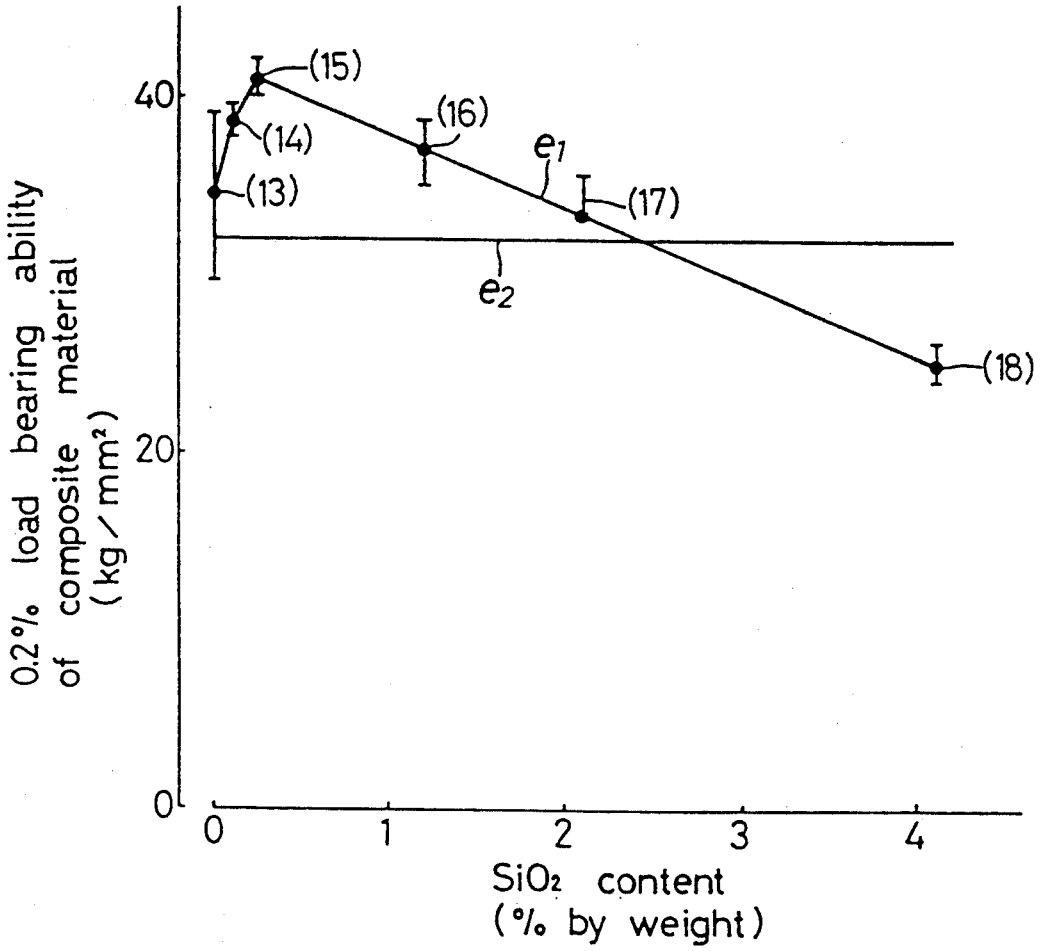
FIG. 3 is a graph illustrating a relationship between the $SiO_2$ content and the strength of another reinforcing molded product.

Results of a tensile test for the individual composite materials (13) to (18) and the simple material are as given in Table 1 and FIG. 3. In FIG. 3, a line $e_1$ corresponds to the composite materials (13) to (18), and a line $e_2$ corresponds to the simple material.

TABLE 1

| Com. Ma. | Content of $SiO_2$ (wt. %) | T. strength (kg.mm$^2$) | 0.2% loading endurance (kg/mm$^2$) |
|---|---|---|---|
| (13) | | 43.6 | 34.6 |
| (14) | 0.1 | 55.6 | 35.5 |
| (15) | 0.25 | 55.0 | 40.5 |
| (16) | 1.2 | 53.2 | 37.2 |
| (17) | 2.1 | 49.0 | 32.1 |
| (15) | 4.1 | 45.2 | 25.3 |

TABLE 1-continued

| Com. Ma. | Content of $SiO_2$ (wt. %) | T. strength (kg.mm$^2$) | 0.2% loading endurance (kg/mm$^2$) |
|---|---|---|---|
| Sim. Ma. | — | 37.7 | 32.0 |

Com. Ma.: Compositie material T. strength: Tensile strength
Sim. Ma.: Simple material As apparent from FIG. 3, setting of the $SiO_2$ content at 0.1 to 2.0% by weight in the composite materials (14) to (17) ensures that the compounding effect is obtained, and the varia-tion in strength is smaller. With the composite material (13), it can be seen that the compounding effect is obtained, on the one hand, and the variation in strength is larger, on the other hand.

In order to insure both of the strength of the reinforcing molded products (FIG. 1) and the strength of the composite materials (FIG. 3) in Examples 1 and 2, the content of $SiO_2$ contained in the silicon carbide whisker may be set in the range of 0.25 to 2.0% by weight.

It should be noted that a silicon carbide grain can be used as a reinforcing material.

Example 3

Using a silicon carbide whisker having a $SiO_2$ content of 1.3% by weight, a vacuum forming process was utilized to produce a reinforcing molded product having a diameter of 86 mm and a thickness of 20 mm.

Using the foregoing reinforcing molded material and aluminum alloy matrices having varied Si contents given in Table II, a pressure casting process was utilized under conditions of a molten metal temperature of 750° C. and a pressing force of 800 kg/cm$^2$ to produce various composite materials (19) to (25).

TABLE II

| Composite material | Chemical constituents (% by weight) Cu | Ma | Si | Al |
|---|---|---|---|---|
| (19) | 3.0 | 0.35 | — | Balance |
| (20) | 3.0 | 0.35 | 3.0 | Balance |
| (21) | 3.0 | 0.35 | 4.0 | Balance |
| (22) | 3.0 | 0.35 | 6.0 | Balance |
| (23) | 3.0 | 0.35 | 7.0 | Balance |
| (24) | 3.0 | 0.35 | 8.0 | Balance |
| (23) | 3.0 | 0.35 | 10.0 | Balance |

Figure 4:
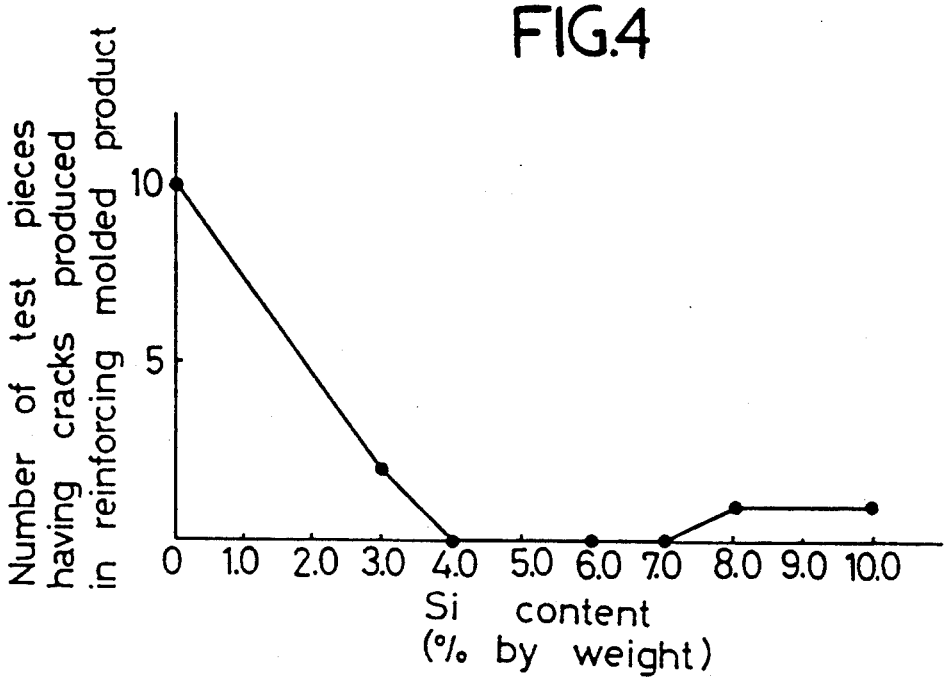
FIG. 4 is a graph illustrating a relationship between the Si content and the number of test pieces having cracks produced in the reinforcing molded product.

Ten test pieces were cut off from each of the Composite materials (19) to (25) and examined for cracks in the reinforcing molded product thereof to provide results given in FIG. 4.

It can be seen from FIG. 4 that no crack is produced in the reinforcing molded products by setting the Si content in the range of 4.0 to 7.0% by weight.

Figure 5:
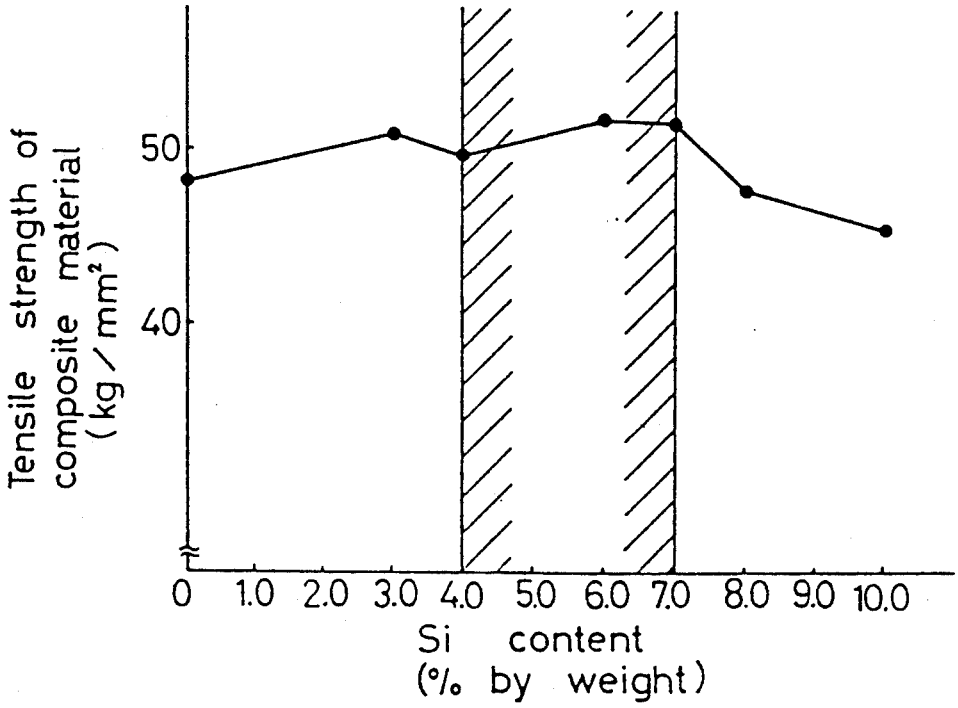
FIG. 5 is a graph illustrating a relationship between the Si content and the tensile strength of a composite material.

Then, three test pieces were cut off from each of the composite materials (19) to (25) and subjected to a tensile test for determination of the average tensile strength and consequently, results given in FIG. 5 were obtained.

It can be seen from FIG. 5 that the reduction of the tensile strength of the composite materials is avoided by setting the Si content in the range of 4.0 to 7.0% by weight.

Example 4

A reinforcing molded product similar to that in Example 3 was produced.

Using such reinforcing molded product and aluminum alloy matrices having varied Cu contents given in Table III, a pressure casting process was utilized under the same conditions as in Example 3 to provide composite materials (26) to (31).

TABLE III

| Composite material | Chemical constituents (% by weight) Cu | Ma | Si | Al |
|---|---|---|---|---|
| (26) | — | 0.35 | 4.0 | Balance |
| (27) | 1.0 | 0.35 | 4.0 | Balance |
| (28) | 2.0 | 0.35 | 4.0 | Balance |
| (29) | 3.0 | 0.35 | 4.0 | Balance |
| (30) | 4.0 | 0.35 | 4.0 | Balance |
| (31) | 5.0 | 0.35 | 4.0 | Balance |

Figure 6:
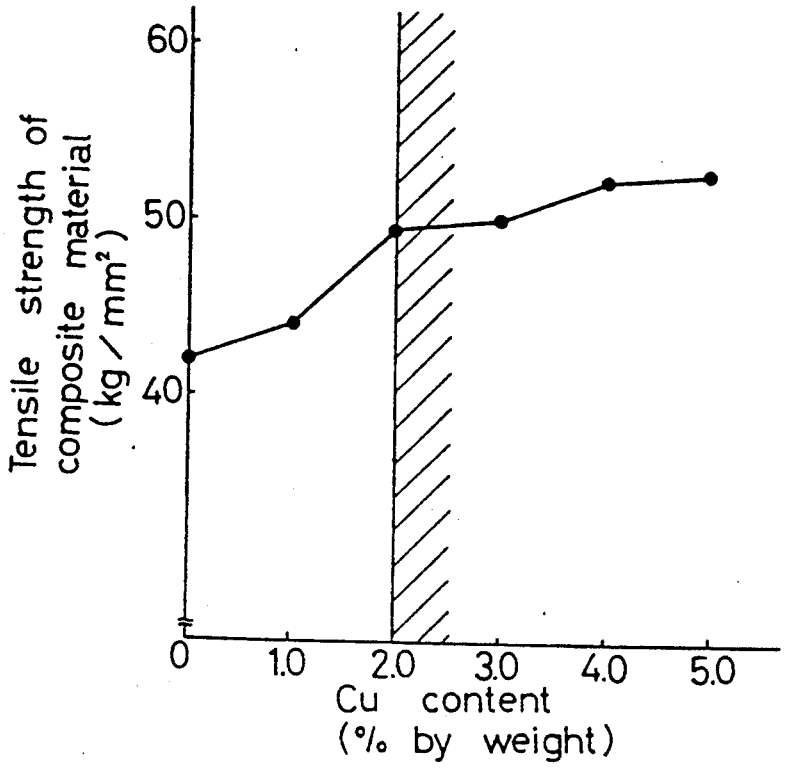
FIG. 6 is a graph illustrating a relationship between the Cu content and the tensile strength of the composite material.
Figure 7:
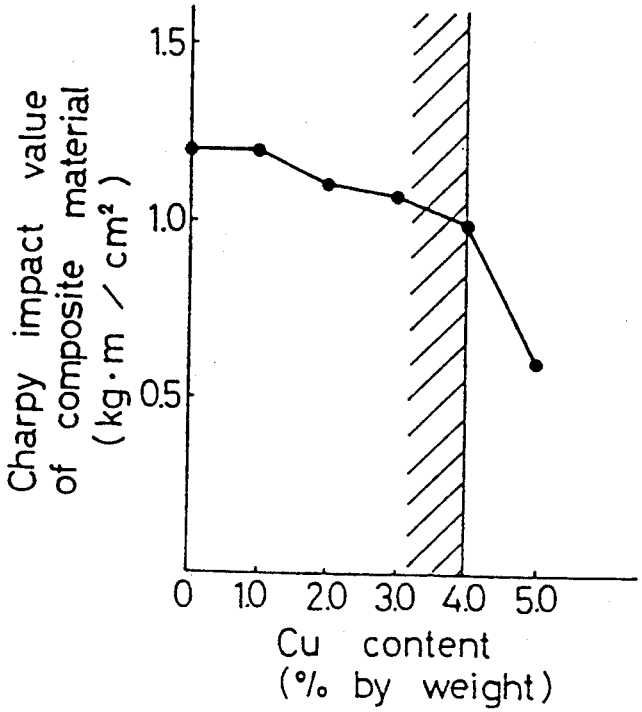
FIG. 7 is a graph illustrating a relationship between the Cu content and Charpy impact value of the composite material.

Test pieces were cut off from the composite materials (26) to (31) and subjected to a tensile test and to Charpy impact test to determine the tensile strength and Charpy impact strength and consequently, results given in FIGS. 6 and 7 were obtained.

As apparent from FIGS. 6 and 7, a composite material excel lent in tensile strength and Charpy impact strength can be produced by setting the Cu content in the range of 2.0 to 4.0% by weight.

Example 5

A reinforcing molded product similar to that in Example 3 was made.

Using such reinforcing molded product and aluminum alloy matrices having varied Mg contents given in Table IV, a pressure casting process was utilized under the same conditions as in Example 3 to provide composite materials (32) to (38).

TABLE IV

| Composite material | Chemical constituents (% by weight) Cu | Mg | Si | Al |
|---|---|---|---|---|
| (32) | 3.0 | — | 4.0 | Balance |
| (33) | 3.0 | 0.1 | 4.0 | Balance |
| (34) | 3.0 | 0.25 | 4.0 | Balance |
| (35) | 3.0 | 0.35 | 4.0 | Balance |
| (36) | 3.0 | 0.5 | 4.0 | Balance |
| (37) | 3.0 | 0.75 | 4.0 | Balance |
| (38) | 3.0 | 1.0 | 4.0 | Balance |

Figure 8:
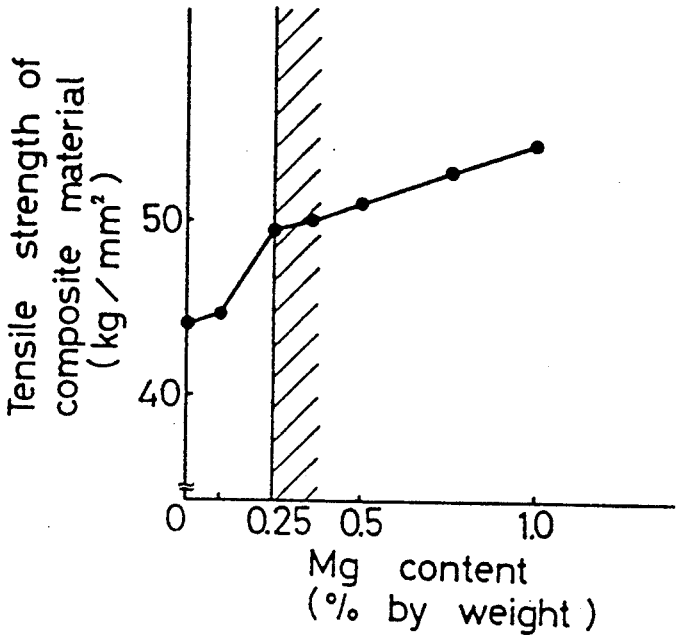
FIG. 8 is a graph illustrating a relationship between the Mg content and the tensile strength of the composite material.
Figure 9:
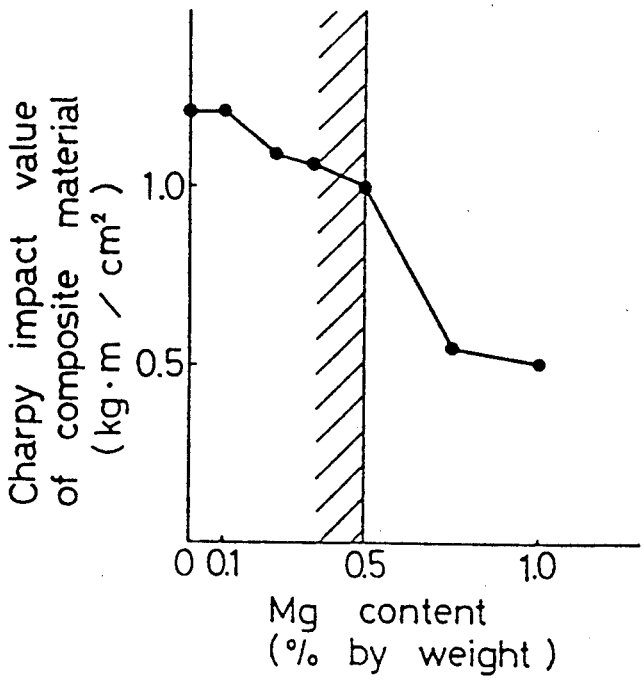
FIG. 9 is a graph illustrating a relationship between the Mg content and Charpy impact value of the composite material.

Test pieces were cut off from the composite materials (32) to (38) and subjected to a tensile test and to Charpy impact test to determine the tensile strength and Charpy impact strength and consequently, results given in FIGS. 8 and 9 were obtained.

As apparent from FIGS. 8 and 9, a composite material excellent in tensile strength and Charpy impact strength can be produced by setting the Mg content in the range of 0.25 to 0.5% by weight.

It should be noted that a silicon carbide grain can be used to produce a reinforcing molded product.

Example 6

Using as a reinforcing material a silicon carbide whisker having a $SiO_2$ content of 1.3% by weight with a diameter of 0.4 μm and a length of 5 to 20 μm (made under a trade name of TOKAMAX by Tokai Carbon Co., Ltd.), a vacuum forming process was utilized to form five disk-like reinforcing molded products. The size of each of the reinforcing molded product was of a diameter of 86 and a thickness of 25 mm, and the volume fraction (Vf) was of about 15%.

An Al-Si based alloy which is not subjected to an improving treatment and has a composition given in Table V was prepared as an aluminum alloy matrix.

TABLE V

| Al—Si based alloy | Chemical constituents (% by weight) Si | Cu | Ma | Al |
|---|---|---|---|---|
| | 5.0 | 3.0 | 0.35 | Balance |

0.05%, 0.07%, 0.10% and 0.15% by weight of Sb was added to the Al-Si based alloy to prepare Al-Si based alloys specially subjected to four improving treatments.

Using the Al-Si based alloys which is and is not subjected to an improving treatment, a pressure casting was conducted under conditions of a heating temperature of 700° C. for 20 minutes in a pretreatment of each of the reinforcing molded products, a mold temperature of 320° C., a molten metal temperature of 750° C. and a pressing force of 800 kg/cm$^2$ to provide composite materials (39) to (43). For comparison, the above Al-Si based alloys were employed to produce simple alloy materials (44) to (48).

Then, the composite materials (39) to (43) and the simple-alloy materials (44) to (48) were subjected to a T6 treat-ment as a thermal treatment. Thereafter, the composite materials and the like were subjected to a tensile test and Charpy impact test to determine the tensile strength and toughness and consequently, results given in FIGS. 10 and 11 were obtained.

Figure 10:
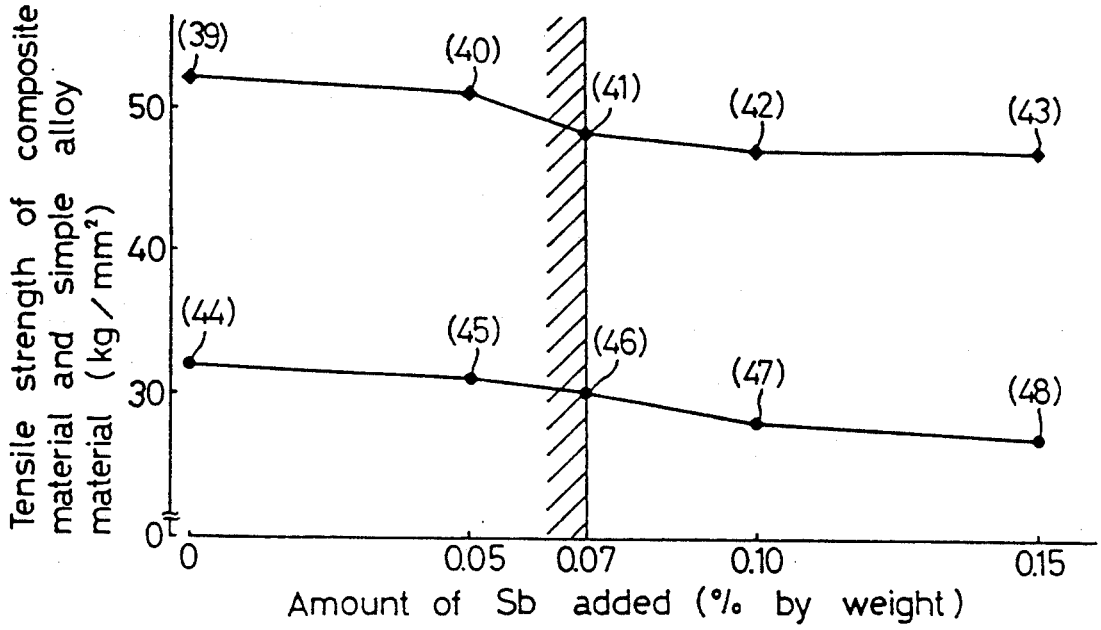
Figure 11:
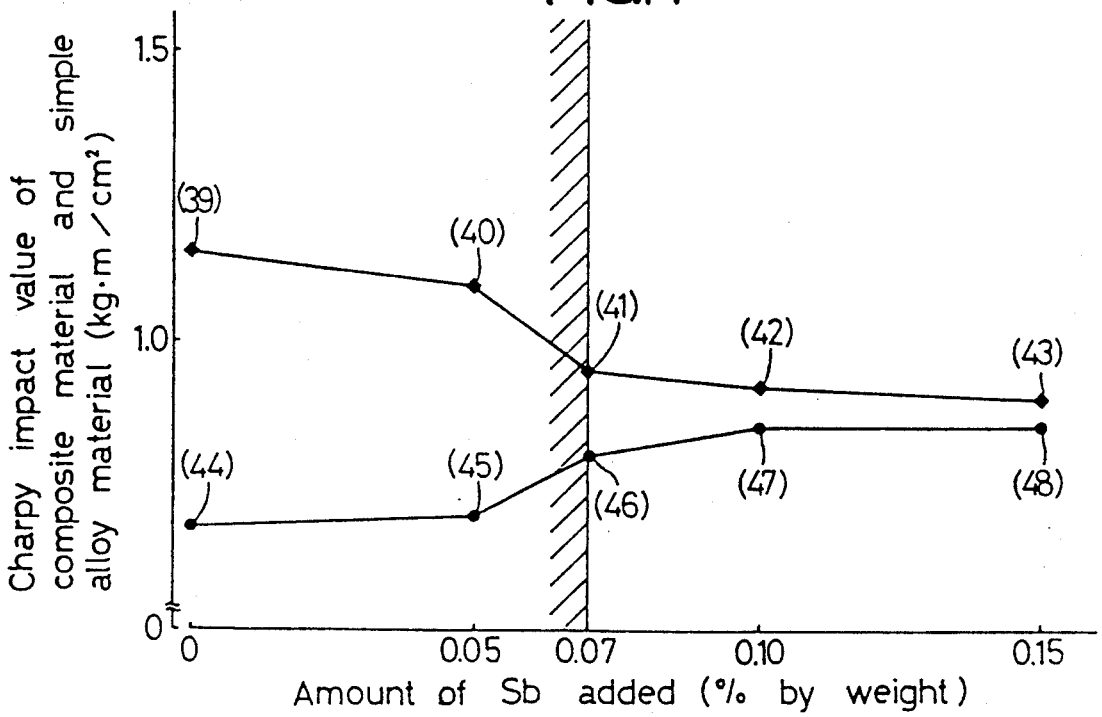

As apparent from FIGS. 10 and 11, the composite material (44) in which the Al-Si based alloy which is not subjected to an improving treatment serves as a matrix has the most excellent tensile strength and Charpy impact value.

When the improving treatment is effected, the amount of Sb added is suitable to be less than 0.07% by weight.

Example 7

A reinforcing molded product made of the same silicon whisker as in Example 6 was formed.

In addition, the same Al-Si based alloy which is not subject to an improving treatment as in Example 6 was also prepared.

Further, Na was added in amounts of 7, 10 and 30 ppm to the above Al-Si based alloy to prepare Al-Si based alloys subjected to three improving treatments.

Then, three composite materials (49) to (51) were produced under the same conditions as described above and were subjected to a T6 treatment, followed by a tensile test and Charpy impact test to provide results given in Table VI.

TABLE VI

| Com. Ma. value | Amount of Na(ppm) | Tensile strength (ka/mm$^2$) | Charpy impact (ka m/cm$^2$) |
|---|---|---|---|
| (39) | — | 52 | 1.15 |
| (49) | 7 | 52 | 1.10 |
| (50) | 10 | 49.5 | 1.00 |
| (51) | 30 | 48.0 | 0.95 |

As apparent from Table VI, when the improving treatment is effected, the amount of Na added is suitable to be less than 10 ppm.

Example 8

A reinforcing molded product made of the same silicon whisker as in Example 6 was formed.

In addition, the same Al-Si based alloy which is not subjected to an improving treatment as in Example 6 was also prepared.

Further, Sr was added in the amounts of 0.02, 0.03 and 0.05% by weight to the above Al-Si based alloy to prepare Al-Si based alloys subjected to three improving treatments.

Then, three composite materials (52) to (54) were produced under the same conditions as described above and were subjected to a T6 treatment, followed by a tensile test and Charpy impact test to provide results given in Table VII.

TABLE VII

| Com. Ma. | Amount of Sr (ppm) | Tensile strength (kg m/cm$^2$) | Charpy impact value (kg m/cm$^2$) |
|---|---|---|---|
| (39) | — | 52.0 | 1.15 |
| (52) | 0.02 | 51.5 | 1.10 |
| (53) | 0.03 | 48.5 | 0.95 |
| (54) | 0.05 | 48.0 | 0.90 |
| Com. Ma. | Composite material | | |

As apparent from Table VII, when the improving treatment is effected, the amount of Sr added is suitable to be less than 0.03% by weight.

A silicon carbide grain can be used as a reinforcing material. In addition to the silicon carbide whisker and the like, it is possible to use a $Si_3N_4$ whisker, a $Si_3N_4$ grain, a carbon whisker, a carbon grain, an alumina whisker, an alumina grain and the like. In this case, it is desirable that the diameter of the individual whisker is less than the particle size of the eutectic crystal silicon (2 to 5 μm).

Example 9

Figure 12:
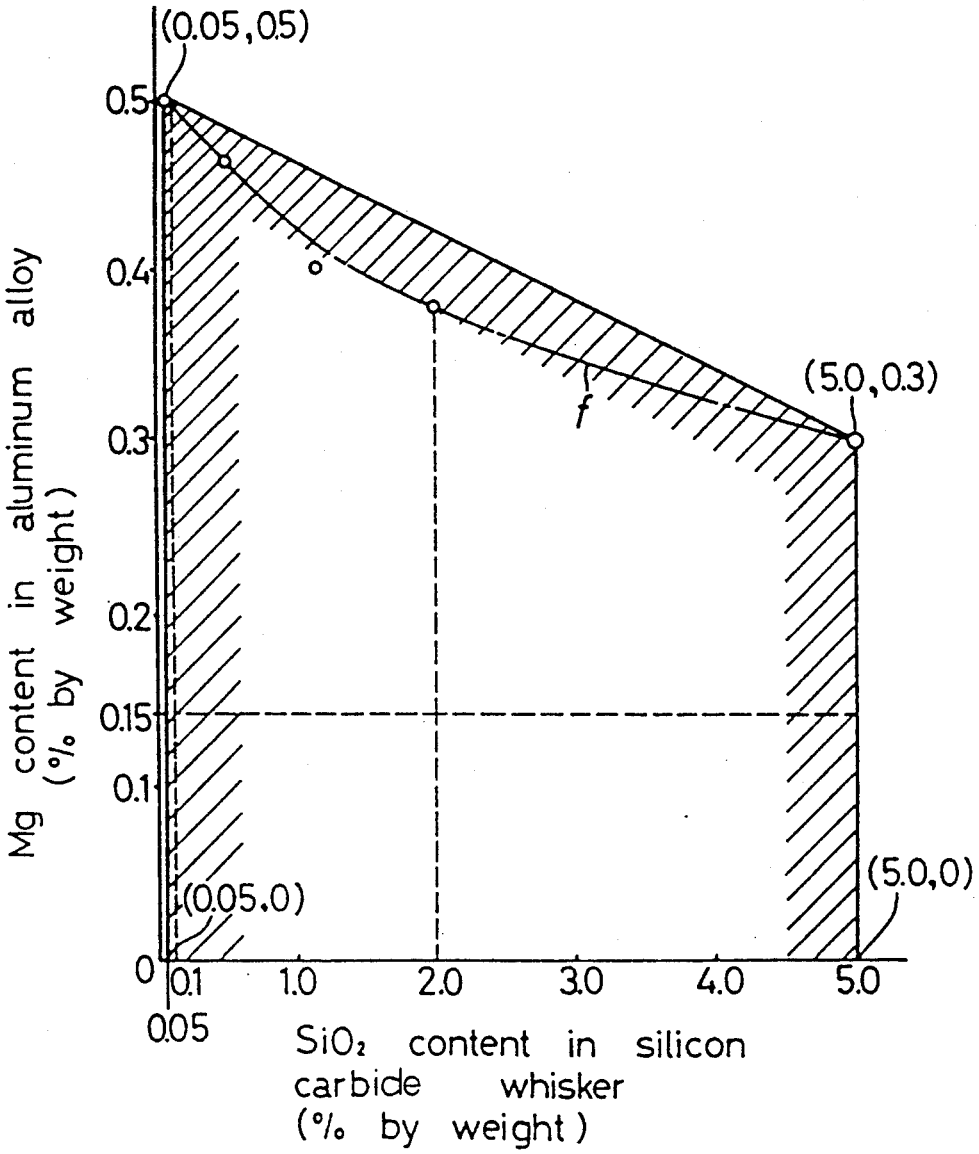
FIG. 12 is a graph illustrating a relationship between the $SiO_2$ content in a silicon carbide whisker and the Mg content in an aluminum alloy.

FIG. 12 illustrates a relationship between the content of $SiO_2$ in the silicon carbide whisker which is a reinforcing material and the content of Mg in the aluminum alloy which is a matrix in a silicon carbide-reinforced aluminum alloy composite material.

The contents of $SiO_2$ and Mg in the present invention are set as coordinates which lie in a region surrounded by a closed line, which connects four coordinates (0.05% by weight, 0), (5.0% by weight, 0), (5.0% by weight, 0.3% by weight), and (0.05% by weight, 0.5% by weight) (but Mg content equal to 0 is excluded) in that order, in a graph wherein the $SiO_2$ content is represented by an abscissa and the Mg content is by an ordinate.

In the relationship between the $SiO_2$ and the Mg content, a preferred example is a secondary curve as indicated by f in FIG. 12.

In the above range, the production of a $Mg_2Si$ intermetallic compound is suppressed and hence, the cuttability of the composite material is improved, and the strength thereof is insured.

When emphasis is put on the strength of the composite material, it is necessary to insure the strength of the reinforcing molded product made of the silicon carbide whisker. For this purpose, it is preferred to set the $SiO_2$ content in the range of 0.1 to 2.0% by weight to provide a binder effect of $SiO_2$ present in the silicon carbide whisker surface layer.

On the other hand, when emphasis is put on the cuttability of the composite material, the Mg content may be set at 0.15% by weight or less.

An example of the most preferred combination of the $SiO_2$ content with the Mg content is such that the $SiO_2$ content is set in the range of 0.1 to 2.0% by weight and the Mg content is set at 0.15% by weight or more. Such a construction makes it possible to keep the cuttability and strength of the composite material optimal.

Various composite materials were produced in the following procedure to conduct a tool wear test.

First, five silicon carbide whiskers having $SiO_2$ contents set at 0.05%, 0.5%, 1.2%, 2.0% and 5.0% by weight respectively were prepared, and using forming materials having the silicon carbide whiskers dispersed in a distilled water, a vacuum forming process was utilized to form five disk-like reinforcing molded products. The size of each of the reinforcing molded products was such that it had a diameter of 80 mm and a thickness of 50 mm, and the volume fraction (Vf) of the reinforcing molded product was of 20%.

Al-Mg based alloys having varied Mg contents were prepared as an aluminum alloy, and a pressure casting was conducted under conditions of a heating temperature of 700° C. for 20 minutes in a preheating treatment of each reinforcing molded product, a mold temperature of 320° C., a molten metal temperature of 750° C. and a pressing force of 1,000 kg/cm$^2$ provide various composite materials.

Figure 13:
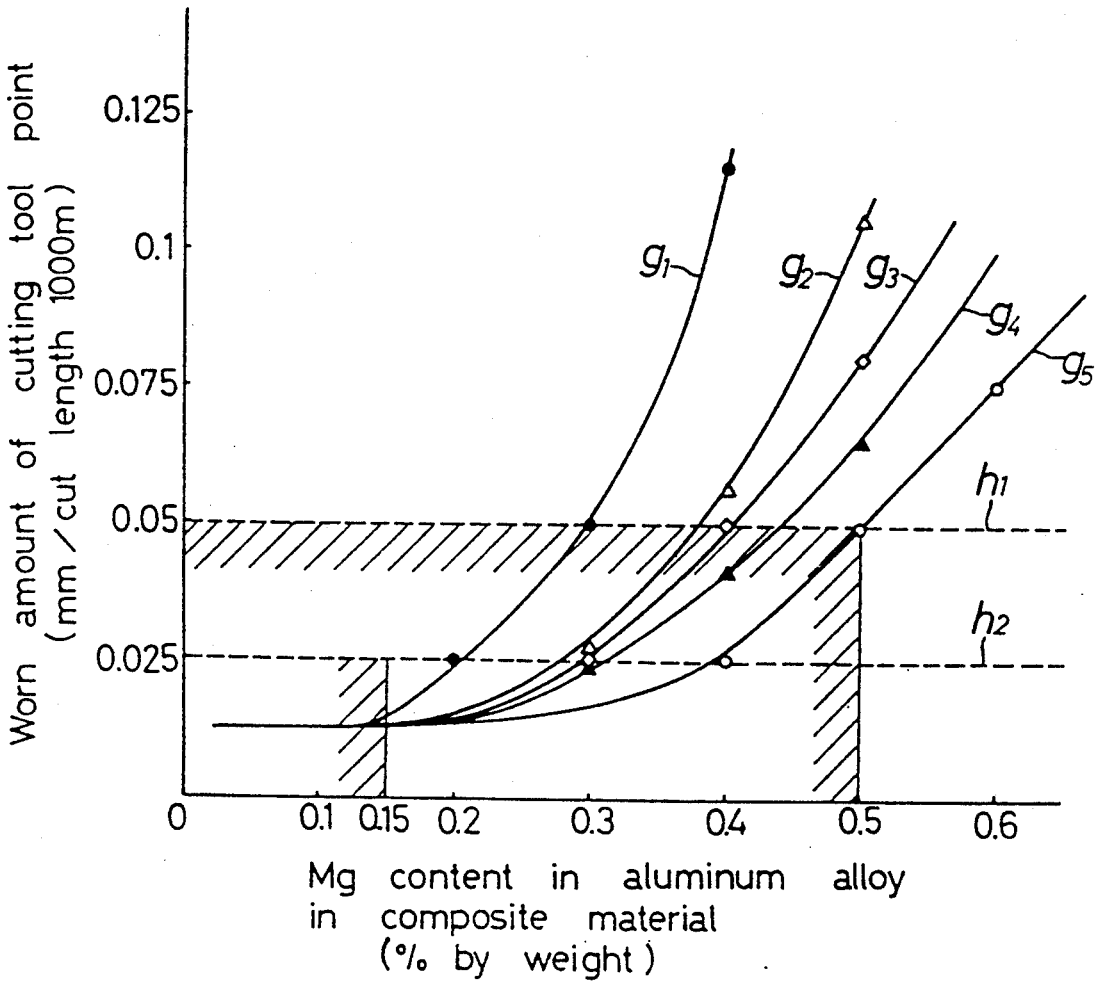
FIG. 13 is a graph illustrating a relationship between the Mg content in the aluminum alloy in the composite material and the amount of cutting tool point worn.

FIG. 13 illustrates results of the tool wear test conducted for the various composite materials. The worn amount is given as an amount of tool point worn when the cut length has reached 1,000 m upon cutting of each of the composite materials by the tool.

In FIG. 13, lines $g_1$ to $g_5$ correspond to those when the $SiO_2$ contents are of 5.0%, 2.0%, 1.2%, 0.5% and 0.05% by weight, respectively. In addition, a line $h_1$ indicates a cutting acceptable level, and a line $h_2$ indicates a mass production level with a further improved cuttability.

As apparent from FIG. 13, the cutting acceptable level indicated by the line $h_1$ can be satisfied by setting the Mg content at 0.5% by weight or less and the $SiO_2$ content in the range of 0.05 to 5.0% by weight in each of the composite materials.

It should be noted that a silicon carbide grain can be used as a reinforcing material.

Example 10

Using silicon carbide whiskers having a $SiO_2$ content of 1.3% by weight (made under a trade name of TOKAMAX by Tokai Carbon Co., Ltd.), they were placed into a mixer and subjected to an opening treatment. In this case, the treating time was adjusted, thereby providing eight mixed silicon carbide whiskers containing 0.1%, 0.2%, 0.5%, 1.0%, 2.5%, 4.0%, 5.0% and 6.0% by volume of unopened and substantially spherical silicon carbide whisker aggregate based on the opened silicon carbide whisker portion. The diameter of the silicon carbide whisker aggregate was of approximately 80 Nm, and the volume fraction (Vf) thereof was of 3%. For comparison, a silicon carbide whisker (having a $SiO_2$ content of 1.3% by weight) with all the silicon carbide whisker aggregate removed was also prepared.

Using the above-described silicon carbide whiskers, a vacuum forming process was utilized to form nine disk-like reinforcing molded products. The size of the each of the reinforcing molded products was such that it had a diameter of 86 mm and a thickness of 25 mm, and the volume fraction thereof was of 15%.

An aluminum alloy (a material corresponding to JIS AC4C) was prepared as a matrix of a light weight alloy, and a pressure casting was conducted under conditions of a heating temperature of 700° C. for 20 minutes in a preheating treatment of each reinforcing molded product, a mold temperature of 320° C., a molten metal temperature of 750° C. and a pressing force of 800 kg/cm$^2$ to provide nine composite materials (55) to (63).

*Then, the individual composite materials (55) to (63)* were subjected to a T6 treatment as a thermal treatment.

Test pieces were cut off from each of the composite materials (55) to (63). They were used as chips and subjected to a chip-on-disk wear test to provide results given in FIG. 14.

Test conditions were as follows. Disk: made from a cast iron; surface pressure 200 kg/cm$^2$; circumferential velocity 1.0 m/sec.; oil temperature 100° C. at the time of supply; oil supply rate 44.6 cc/min.; and sliding distance: 1,000 m.

Figure 14:
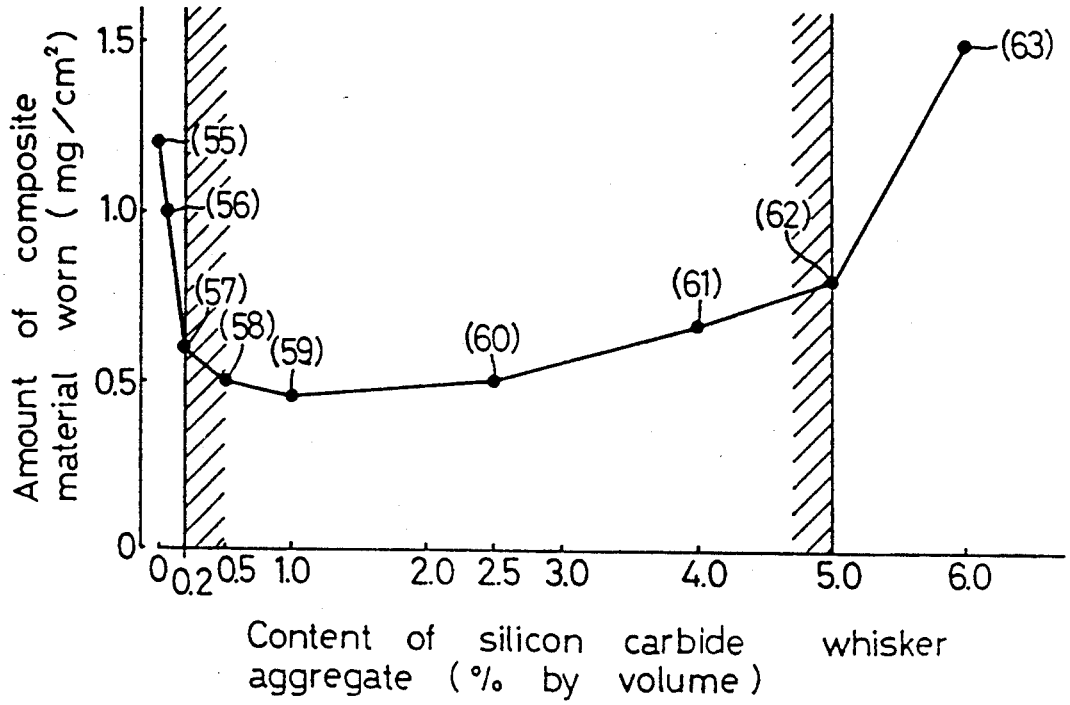
FIG. 14 is a graph illustrating a relationship between the content of a silicon carbide whisker aggregate and the amount of composite material worn.

As apparent from FIG. 14, composite materials (57) to (62) having an excellent wear resistance can be produced by setting the content of the silicon carbide whisker aggregate in the range of 0.2 to 5.0% by volume.

Figure 15:
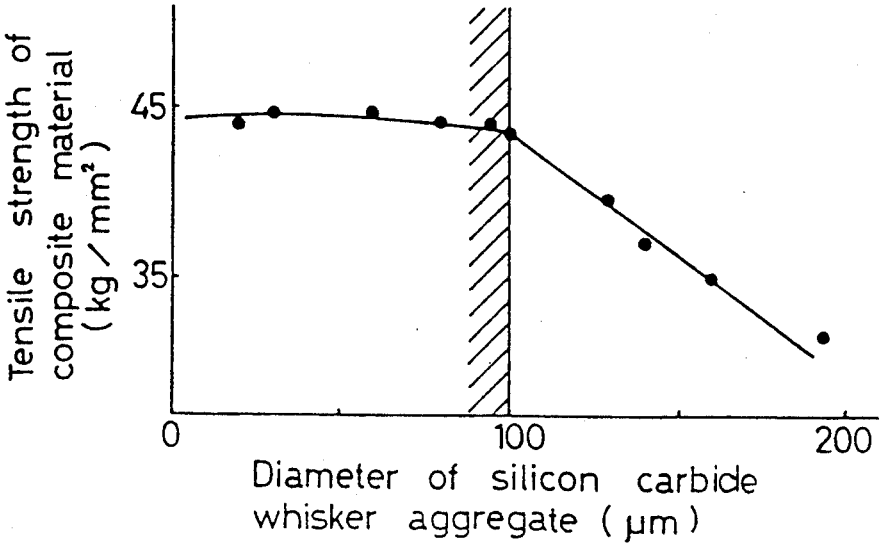
FIG. 15 is a graph illustrating a relationship between the diameter of the silicon carbide whisker aggregate and the tensile strength of the composite material.

FIG. 15 illustrates a relationship between the diameter of the silicon carbide whisker aggregate in a composite material equivalent to the above composite material (58) and containing 0.5% by volume of the silicon carbide whisker aggregate with its volume fraction set at 20 to 25%, and the tensile strength of the composite material.

As apparent from FIG. 15, if the diameter of the silicon carbide whisker aggregate is of 100 μm or less, the tensile strength of the composite material can be improved.

As a result of various reviews, the volume fraction of the silicon carbide whisker aggregate is suitable to be in the range of 15 to 30%. If the volume fraction is less than 15%, that value is substantially equal to the volume fraction of the silicon carbide whisker dispersed in the matrix, resulting in a loss in advantage of using the silicon carbide whisker aggregate and in a reduced wear resistance of the composite material. On the other hand, if the volume fraction is more than 30%, the falling of the molten metal in the silicon carbide whisker aggregate is deteriorated to reduce the anchoring effect by the matrix and hence, the aggregate is liable to fall off.

It should be noted that in addition to the silicon carbide whisker, a $Si_3N_4$ whisker, a carbon whisker and the like can be used.

Example 11

A silicon carbide whisker having the $SiO_2$ content set in the range of 1.2 to 1.3% by weight was prepared, and using a forming material containing such silicon carbide whisker dispersed in distilled water, a vacuum forming process was utilized to form a plurality of disk-like reinforcing molded products. The size of each reinforcing molded product was such that it had a diameter of 86 mm and a thickness of 25 mm, and the volume fraction (Vf) thereof was of 14%.

An alloy corresponding to JIS AZ91D was prepared as a magnesium alloy, and given amounts of Ca were added thereto to prepare molten metals having various compositions.

Then, a pressure casting was conducted under conditions of a heating temperature of 700° C. for 20 minutes in a preheating treatment of each of the reinforcing molded products, a molded temperature of 320° C., a molten metal temperature of 700° to 760° C. and a pressing force of 600 to 700 kg/cm$^2$ to provide various composite materials.

Figure 16:
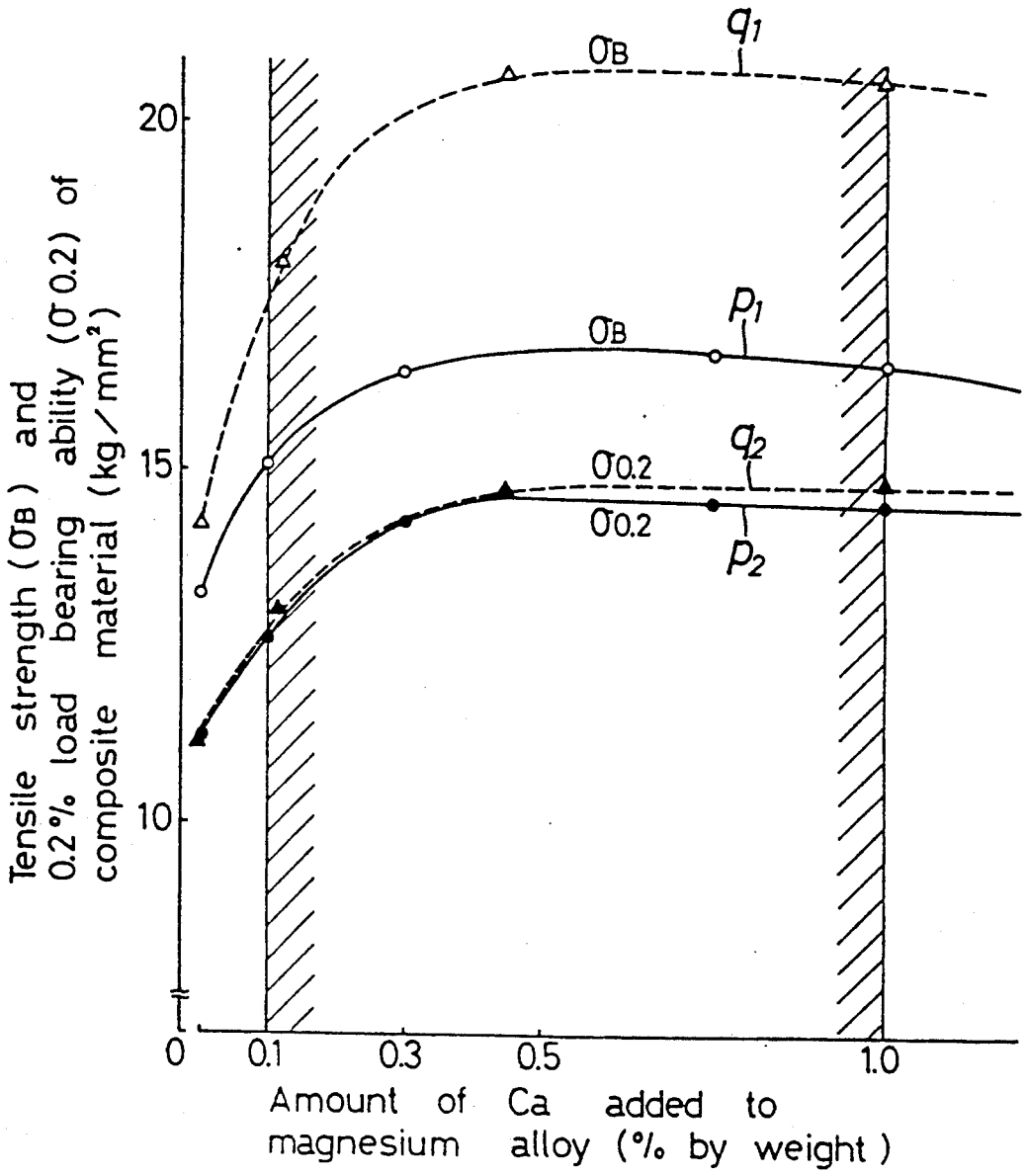
FIG. 16 is a graph illustrating a relationship between the amount of Ca added to a magnesium alloy and the tensile strength as well as the 0.2% load bearing ability of the composite material.

FIG. 16 illustrates results of a high-temperature tensile test at 100° C. of each composite material. A line $p_1$ corresponds to the tensile strength of the composite *material, and a line $p_2$ corresponds to a 0.2% load bearing* ability of the composite material.

As apparent from the lines $p_1$ and $p_2$ in FIG. 16, the strength of the composite material can be improved by setting the amount of Ca added in the range of 0.1 to 1.0% by weight. From the viewpoint of the improvement in strength, the amount of Ca added is preferred to be of 0.3% by weight or more.

A mixture of an alumina short fiber (made under a trade name of Saffil RF by ICI Co., Ltd., and containing 4% of $\alpha$-$Al_2O_3$) added to the silicon carbide whisker having the above-described composition was prepared, and a plurality of disk-like reinforcing molded products were formed in the same procedure. The size of each of the reinforcing molded products was the same as described above, and the volume fraction (Vf) thereof was of 14%. The volume fractions of the silicon carbide whisker and the alumina short fiber were of 7%, respectively.

Using each of the reinforcing molded products and using the same molten metal as described above, various composite materials were produced under the same conditions as described above.

In FIG. 16, a line $q_1$ corresponds to the tensile strength of the composite material made using the above-described fiber mixture, and a line $q_2$ corresponds to the 0.2% load bearing ability of such composite material.

As apparent from the line $q_1$ in FIG. 16, the composite material made using the fiber mixture comprising the alumina fiber added to the silicon carbide whisker is improved in high-temperature strength as compared with the composite material made using the silicon carbide whisker alone and indicated by the line $p_1$.

Example 12

Various silicon carbide whiskers having varied $SiO_2$ contents were prepared, and using various forming materials containing the silicon carbide whiskers dispersed in distilled water, a vacuum forming process was utilized to form a plurality of disk-like reinforcing molded products. The size of each of the reinforcing molded products was such that it had a diameter of 86 mm and a thickness of 25 mm, and the volume fraction (Vf) thereof was of 15%.

An alloy corresponding to JIS AZ91D was prepared as a magnesium alloy, and 0.5% by weight of Ca was added thereto to prepare a molten metal.

Then, a pressure casting was conducted under conditions of a heating temperature of 700° C. for 20 minutes in a preheating treatment of each reinforcing molded product, a mold temperature of 320° C., a molten metal temperature of 700° to 760° C. and a pressing force of 600 to 700 kg/cm$^2$ to provide various composite materials.

For comparison, using the same reinforcing molded product as described above, a similar molten alloy having no Ca added was prepared, and a pressure casting was conducted under the same conditions as described above to provide various composite materials.

Figure 17:
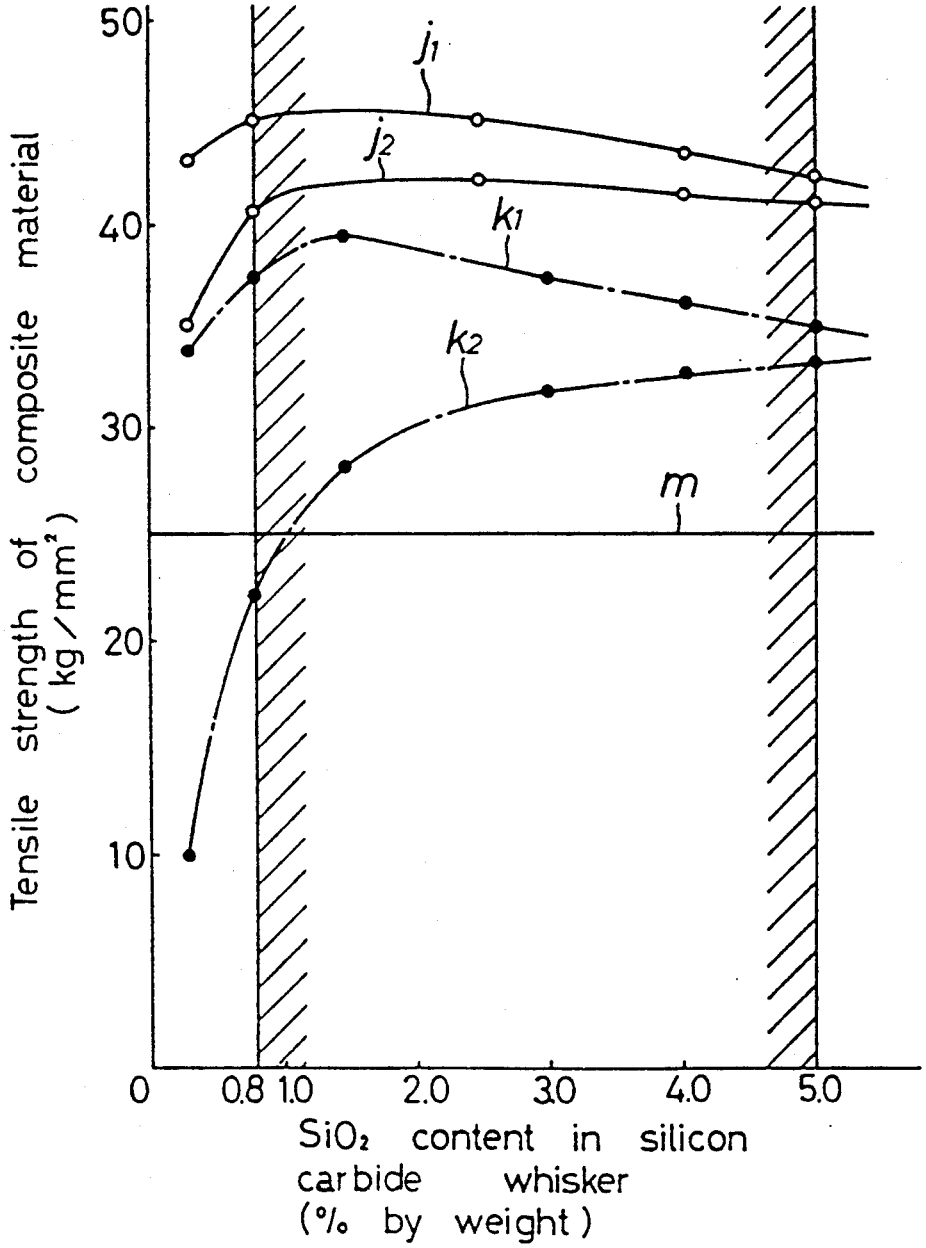
FIG. 17 is a graph illustrating a relationship between the $SiO_2$ content in the silicon carbide whisker and the tensile strength of the composite material.

FIG. 17 illustrates results of a tensile test at room temperature for the composite materials. In FIG. 17, line $j_1$ and $j_2$ indicate the maximum and minimum tensile strengths of the composite materials containing Ca added, and lines $k_1$ and $k_2$ indicate the maximum and minimum tensile strengths of the composite materials containing no Ca added. A line m corresponds to the tensile strength of the simple magnesium alloy material containing no Ca added.

As apparent from the lines $j_1$ to $j_2$ in FIG. 17, an improvement in tensile strength and the suppression of variation in tensile strength are observed in the composite materials according to the present invention and containing Ca added and having the $SiO_2$ content set in the range of 0.8 to 5.0% by weight, but the tensile strength of the composite materials containing no Ca added and indicated by the lines $k_1$ and $k_2$ in FIG. 17 is low as compared with those of the composite materials of the present invention, and the variation in tensile strength is also larger.

It should be noted that a silicon carbide grain can be used as a reinforcing material.

Example 13

Various silicon carbide whiskers having varied $SiO_2$ contents were prepared, and using various forming materials containing the silicon carbide whiskers dispersed in distilled water, a vacuum forming process was utilized to form a plurality of disk-like reinforcing molded products. The size of each reinforcing molded product was such that it had a diameter of 86 mm and a thickness of 25 mm, and the volume fraction (Vf) thereof was of 15%.

A molten alloy corresponding to JIS AZ91D was prepared as a magnesium alloy.

Then, a pressure casting was conducted under conditions of a heating temperature of 700° C. for 10 minutes in a preheating treatment of each reinforcing molded product, a mold temperature of 320° C., a molten metal temperature of 700° to 760° C. and a pressing force of 600 to 700 kg/cm$^2$.

Figure 18:
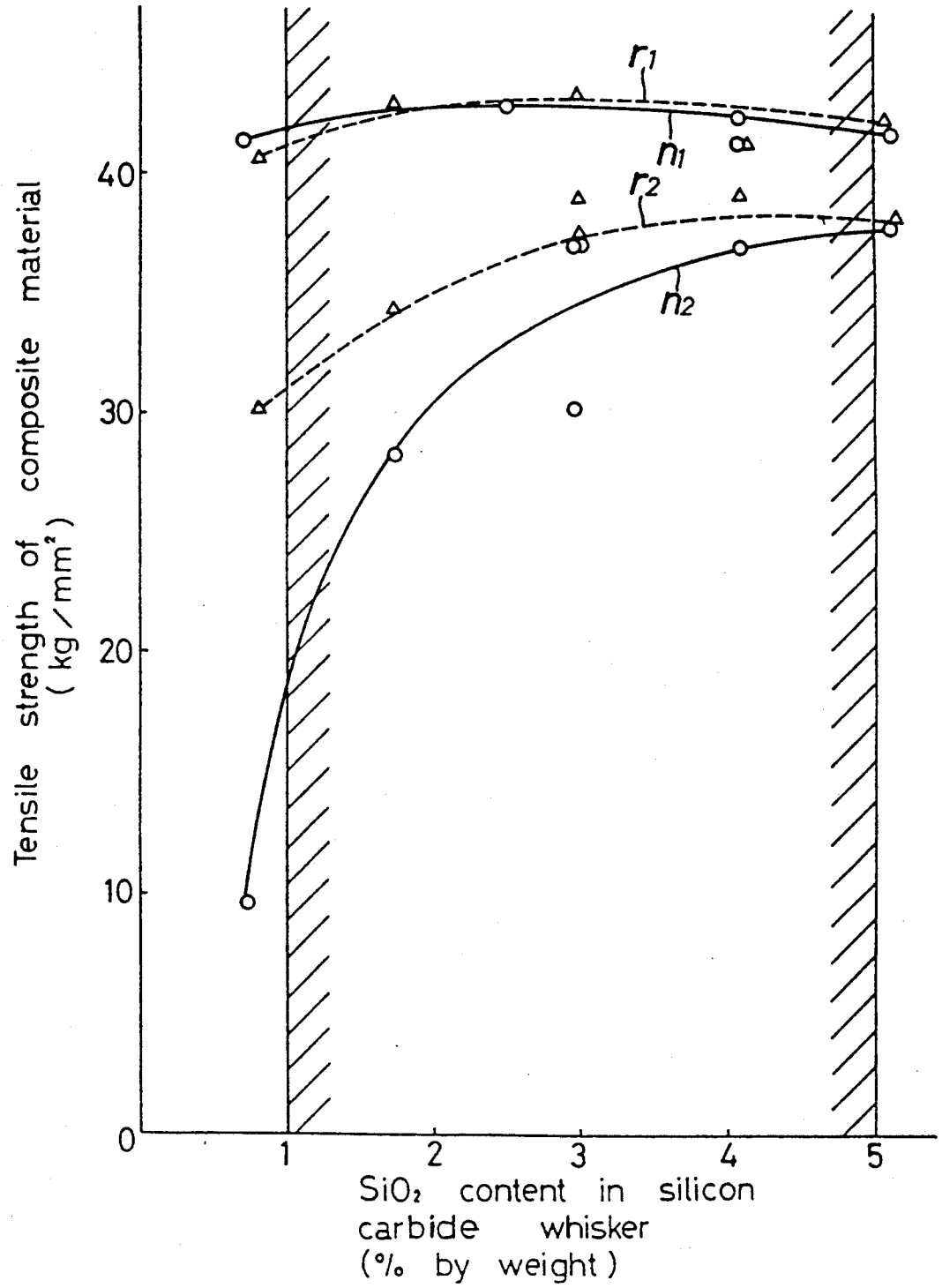
FIG. 18 is a graph illustrating a relationship between the $SiO_2$ content in the silicon carbide whisker and the tensile strength of the composite material.

FIG. 18 illustrates a strength characteristic of such a composite material, wherein a line $n_1$ corresponds to the maximum tensile strength, and a line $n_2$ corresponds to the minimum tensile strength. As apparent from the lines $n_1$ and $n_2$ in FIG. 18, a high strength composite material having an improved tensile strength and a decreased variation in tensile strength can be produced by setting the $SiO_2$ content in the silicon carbide whisker in the range of 1 to 5% by weight.

A fiber mixture comprising an alumina short fiber (made under a trade name of Saffil RF by ICI Co., Ltd., and containing 4% of $\alpha$-$Al_2O_3$) added to the silicon carbide whisker in the same manner was prepared, and the same procedure was utilized to form a plurality of disk-like reinforcing molded products. The size of each reinforcing molded product was the same as described above, and the volume fraction (Vf) thereof was of 15%, wherein the volume fraction of the silicon carbide whisker was of 8%, and the volume fraction of the alumina fiber was of 7%.

Using each reinforcing molded product and using the same molten metals as described above, a various composite materials were produced under the same conditions as described above.

In FIG. 18, a line $r_1$ corresponds to the maximum tensile strength of the composite material made using the fiber mixture, and the line $r_2$ corresponds to the minimum tensile strength of such composite material.

As apparent from the lines $r_1$ and $r_2$, the composite material made using the fiber mixture comprising the alumina fiber added to the silicon carbide whisker is improved in minimum tensile strength as compared with the composite material made using the silicon carbide alone and indicated by the lines $n_1$ and $n_2$, resulting in a further reduced variation in strength.

Example 14

Three silicon carbide whiskers having a $SiO_2$ content of 1.3% by weight were prepared as a reinforcing material. Each of the silicon carbide whiskers contains all of Fe, Cu, Ni and Co as corrosion promoting constituents which hinder the corrosion resistance of the magnesium alloy matrix, wherein the first whisker contains the total content of the corrosion promoting constituents of 0.11% by weight; the second whisker contains the total content of 0.3% by weight, and the third whisker contains the total content of 0.46% by weight.

Using three forming materials containing the silicon carbide whiskers dispersed in distilled water, a vacuum forming process was utilized to form disk-like reinforcing molded products having various volume fractions. The size of each reinforcing molded product was such that it had a diameter of 86 mm and a thickness of 25 mm.

An alloy corresponding to JIS AZ91D and having a corrosion resistance was prepared as a magnesium alloy, and a pressure casting was conducted under conditions of a heating temperature of 700° C. for 20 minutes in a preheating treatment of each reinforcing molded product, a mold temperature of 320° C., a molten metal temperature of 700° to 760° C. and a pressing force of 600 to 700 kg/cm$^2$ to provide various composite materials.

Figure 19:
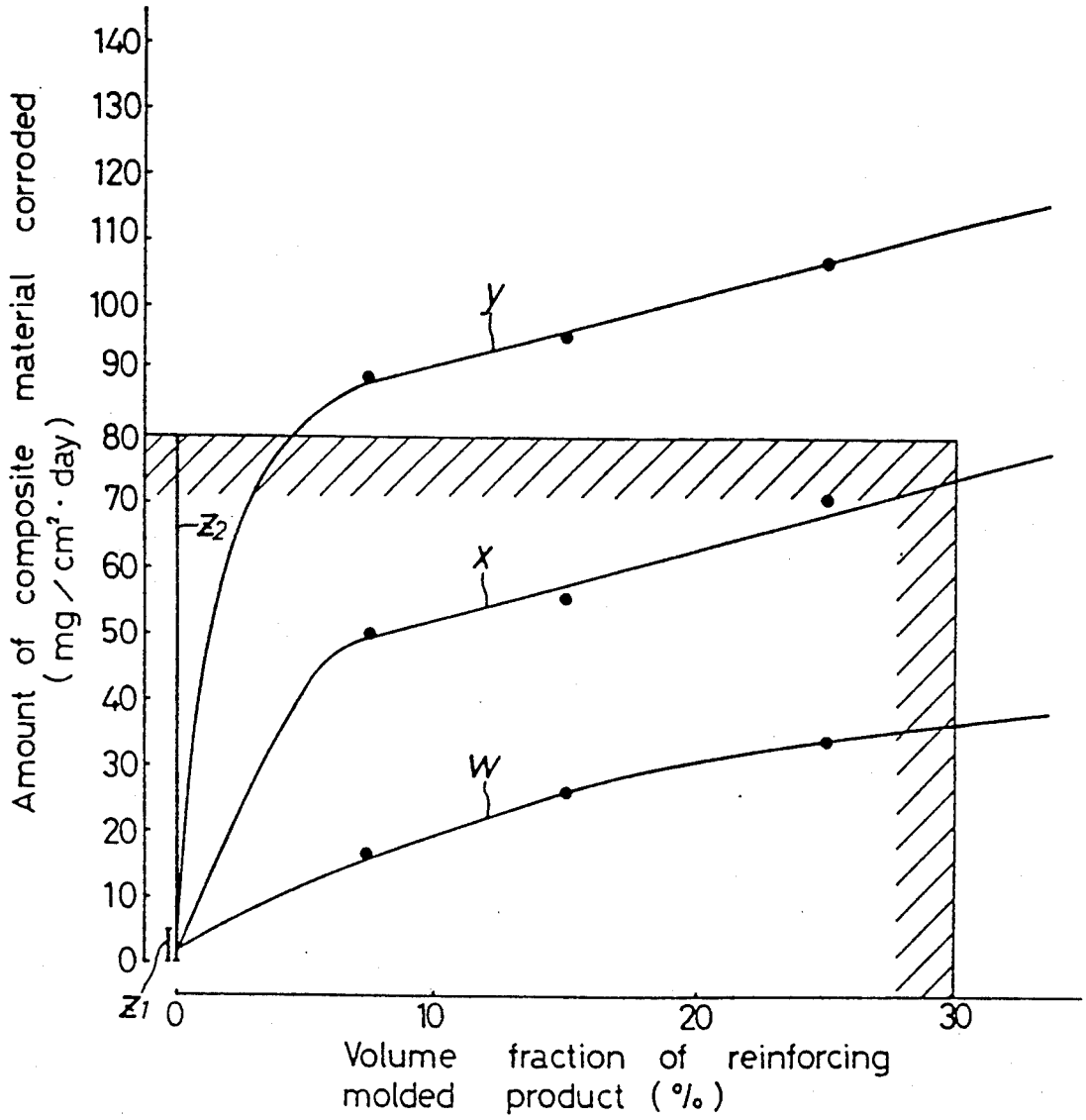
FIG. 19 is a graph illustrating a relationship between the volume fraction of the reinforcing molded product and the amount of composite material corroded.

Using the individual composite materials, a saline solution spraying test (JIS Z-2301) as a corrosion test was conducted to provide results given in FIG. 19.

The test was conducted in sequence of a saline solution spraying, wetting and drying. The test conditions are as follows: Spraying of a saline solution for 4 hours; wetting maintained for 14 to 15 hours in an environment at a temperature of 50° C. and at a relative humidity of 95%; and a drying main-tained at a temperature of 50° to 60° C. for 2 hours. The total test time including the time required to carry the composite material and the like was 24 hours.

In FIG. 19, a line w indicates the corroded amount of the composite material having the total content of the corrosion promoting constituents of 0.11% by weight; a line x indicates the corroded amount of the composite material having the total content of the corrosion promoting constituents of 0.3% by weight, and a line v indicates the corroded amount of the composite material having the total content of the corrosion promoting constituents of 0.46% by weight.

As apparent from the lines w and x in FIG. 19, if the total content of the corrosion promoting constituents is set at 0.3% by weight or less, the corrosion resistance of the composite material can be substantially improved.

In FIG. 19, a line $z_1$ indicates results of the corrosion test for the simple alloy material corresponding JIS AZ91D, and a line $z_2$ indicates results of the corrosion test for the simple alloy material corresponding JIS AZ91B.

With the composite materials indicated by the lines w and x, it is necessary to set the volume fraction of the reinforcing molded product at 30% or less in order to provide a corrosion resistance substantially equivalent to that of the simple alloy material corresponding to JIS AZ91B.

The above Examples in which the silicon carbide whisker contains all of Fe, Cu, Ni and Co as corrosion promoting constituents have been described, but even when the silicon carbide whisker contains one or more of these constituents, if the content of such constituent or constituents exceeds 0.3% by weight, the corrosion resistance of the composite material is substantially degraded likewisely. Therefore, even in such a case, the upper limit value for the constituents is limited to 0.3% by weight.

A silicon carbide grain may be used in the present invention. In addition to the silicon carbide whisker and the like, it is possible to use a $Si_3N_4$ whisker, a carbon whisker and the like. If necessary, a $Si_3N_4$ grain and a carbon grain may be used as a reinforcing material.

What is claimed is:

1. A silicon carbide-reinforced light weight alloy composite material comprising a matrix of a light weight alloy and a reinforcing material which consists of a silicon carbide whisker, wherein the content of $SiO_2$ contained in said reinforcing material is set in a range of 0.05 to 5.0% by weight, said composite material containing a substantially spherical silicon carbide whisker aggregate having a volume fraction higher than the volume fraction of said silicon carbide whisker, with the diameter of the silicon carbide whisker aggregate being set at 100 μm or less, and the content of the silicon carbide whisker aggregate based on said silicon carbide whisker being set in a range of 0.2 to 5.0% by volume.

2. A silicon carbide-reinforced light weight alloy composite material according to claim 1, wherein the volume fraction of said silicon carbide whisker aggregate is set in a range of 15 to 30%.

3. A silicon carbide-reinforced light weight alloy composite material according to claim 1 or 2, wherein said light weight alloy is an aluminum alloy, and said $SiO_2$ content is in a range of 0.1 to 4.0% by weight.

4. A silicon carbide-reinforced light weight alloy composite material according to claim 3, wherein said $SiO_2$ content is in a range of 0.25 to 2.0% by weight.

5. A silicon carbide-reinforced light weight alloy composite material according to claim 3, wherein said aluminum alloy is one selected from the group consisting of an Al-Cu base alloy containing 4% by weight or less of Cu, an Al-Mg based alloy containing 1% by weight or less of Mg, and an Al-Si based alloy containing 7% by weight or less of Si.

6. A silicon carbide-reinforced light weight alloy composite material according to claim 3, wherein said aluminum alloy comprises 4.0 to 7.08% by weight of Si, 2.0 to 4.0% by weight of Cu, 0.25 to 0.5% by weight of Mg and the balance of Al.

7. A silicon carbide-reinforced light weight alloy composite material according to claim 3, wherein said aluminum alloy is an Al-Si based alloy which is not subjected to an improving treatment.

8. A silicon carbide-reinforced light weight alloy composite material according to claim 3, wherein said aluminum alloy is an Al-Si based alloy which is subjected to an improving treatment affected by adding one element selected from Sb, Na and Sr, and the amount of Sb added is set at less than 0.07% by weight; the amount of Na added is set at less than 10 ppm; and the amount of Sr added is set at 0.03% by weight.

9. A silicon carbide-reinforced light weight alloy composite material according to claim 5, wherein said $SiO_2$ content is in a range of 0.25 to 2.0% by weight.

10. A silicon carbide-reinforced light weight alloy composite material comprising a matrix of a light weight alloy and a reinforcing molded product, said product consisting of at least one of a silicon carbide whisker and a silicon carbide grain, said composite material being produced by utilizing a pressure casting process, wherein said light alloy is an aluminum alloy which comprises 4.0 to 7.0% by weight of Si, 2.0 to 4.0% by weight of Cu, 0.25 to 0.5% by weight of Mg and the balance of Al.

11. A silicon carbide-reinforced light weight alloy composite material comprising a matrix of a light weight alloy and a reinforcing material, said reinforcing material, consisting of at least one of a silicon carbide whisker and a silicon carbide grain wherein said reinforcing material contains $SiO_2$ and said light weight alloy is an aluminum alloy containing Mg, with the content of $SiO_2$ in said reinforcing material and the Mg content in the aluminum alloy being set as coordinates which lie in a region (but the Mg Content equal to zero is excluded) surrounded by a closed line, which connects four coordinates (0.05% by weight, 0), (5.0% by weight, 0), (5.0% by weight, 0.3% by weight), and (0.05% by weight, 0.5% by weight) in that order, in a graph where the $SiO_2$ content (% by weight) is represented by an abscissa, and the Mg content (% by weight) is by an ordinate.

12. A silicon carbide-reinforced light weight alloy composite material according to claim 11, wherein the $SiO_2$ content in said reinforcing material is set in a range of 0.1 to 2.0% by weight.

13. A silicon carbide-reinforced light weight alloy composite material according to claim 11 or 12, wherein the Mg content in said aluminum alloy is set at 0.15% by weight or less.

14. A silicon carbide-reinforced light weight alloy composite material according to claim 12, wherein the $SiO_2$ content in said reinforcing material is set in a range of 0.1 to 2.0% by weight, and the Mg content in said aluminum alloy is set at 0.15% by weight or more.

15. A silicon carbide-reinforced light weight alloy composite material comprising a matrix of a light weight alloy and a reinforcing material, said reinforcing material consisting of at least one of a silicon carbide whisker and a silicon carbide grain wherein said light weight alloy is an Al-Si base alloy which is not subjected to an improving treatment.

16. A silicon carbide-reinforced light weight alloy composite material comprising a matrix of a light weight alloy and a reinforcing material, said reinforcing material consisting of at least one of a silicon carbide whisker and a silicon carbide grain, said light weight alloy being an Al-Si based aluminum alloy subjected to an improving treatment effected by adding one element selected from the group consisting of Sb, Na and Sr, wherein the amount of Sb added is set at leas than 0.07% by weight; the amount of Na added is set at less than 10 ppm, and the amount of Sr added is set at less than 0.03% by weight.

17. A silicon carbide-reinforced light weight alloy composite material comprising a silicon carbide whisker as a reinforcing material, wherein it contains a substantially spherical silicon carbide whisker aggregate having a volume fraction higher than the volume fraction of said silicon carbide whisker, with the diameter of said silicon carbide whisker aggregate being set at 100 μm or less and the content of said silicon carbide whisker aggregate based on the silicon carbide whisker being set in a range of 0.2 to 5.0% by volume.

18. A silicon carbide-reinforced light weight alloy composite material according to claim 17, wherein the volume fraction of said silicon carbide whisker aggregate is set in a range of 15 to 30% by weight.

19. A silicon carbide-reinforced light weight alloy composite material according to claim 1, or 2, wherein said light alloy is a magnesium alloy which contains 0.1 to 1.0% by weight of Ca.

20. A silicon carbide-reinforced light weight alloy composite material according to claim 19, wherein the Ca content is of 0.3% by weight or more.

21. A silicon carbide-reinforced light weight alloy composite material according to claim 19, wherein the $SiO_2$ content is in a range of 0.8 to 5.0% by weight.

22. A silicon carbide-reinforced light weight alloy composite material according to claim 21, wherein the Ca content is of 0.3% by weight or more.

23. A silicon carbide-reinforced light weight alloy composite material according to claim 1 or 2, wherein said light weight alloy is a magnesium alloy, and the $SiO_2$ content in said silicon carbide whisker is in a range of 1.0 to 5.0% by weight.

24. A silicon carbide-reinforced light weight alloy composite material according to claim 23, wherein said reinforcing material contains an alumina short fiber.

25. A silicon carbide-reinforced light weight alloy composite material comprising a matrix of a light weight alloy and a reinforcing material, said reinforcing material consisting of at least one of a silicon carbide whether whisker and a silicon carbide grain, wherein said light weight alloy is a magnesium alloy which contains 0.1 to 1.0% by weight of Ca.

26. A silicon carbide-reinforced light weight alloy composite material according to claim 25, wherein the amount of Ca added is set at 0.3% by weight or more.

27. A silicon carbide-reinforced light weight alloy composite material according to claim 25 or 26, wherein said reinforcing material contains an alumina short fiber.

28. A silicon carbide-reinforced light weight alloy composite material according to claim 1 or 2, wherein said light weight alloy is a magnesium alloy, and said reinforcing material contains one selected from the group consisting of Fe, Cu, Ni and Co as corrosion promoting constituents which hinder the corrosion resistance of said magnesium alloy, with the content of said corrosion promoting constituent being set at 0.3% by weight or less.

29. A silicon carbide-reinforced light weight alloy composite material according to claim 1 or 2, wherein said light alloy is a magnesium alloy, and said reinforcing material contains two or more selected from the group consisting of Fe, Cu, Ni and Co as corrosion promoting constituents which hinder the corrosion resistance of said magnesium alloy, with the total content of said corrosion promoting constituents being set at 0.3% by weight or less.

30. A silicon carbide-reinforced light weight alloy composite material according to claim 28, wherein the volume fraction of said reinforcing material is set at 30% or less.

31. A silicon carbide-reinforced light weight alloy composite material according to claim 29, wherein the volume fraction of said reinforcing material is set at 30% or less.

32. A silicon carbide-reinforced light weight alloy composite material comprising a matrix of a light weight alloy and a reinforcing material, said reinforcing material consisting of at least one of a silicon carbide whisker and a silicon carbide grain, wherein said light alloy is a magnesium alloy, and said reinforcing material contains one element selected from the group of elements consisting of Fe, Cu, Ni and Co as corrosion promoting constituents which hinder the corrosion resistance of said magnesium alloy, with the content of said corrosion promoting constituent being set at 0.3% by weight or less.

33. A silicon carbide-reinforced light weight alloy composite material comprising a matrix of a light weight alloy and a reinforcing material, said reinforcing material consisting of at least one of a silicon carbide whisker and a silicon carbide grain, wherein said light weight alloy is a magnesium alloy, and said reinforcing material contains two or more elements selected from the group consisting of Fe, Cu, Ni and Co as corrosion promoting constituents which hinder the corrosion resistance of said magnesium alloy, with the total content of said corrosion promoting constituents being set at 0.3% by weight or less.

34. A silicon carbide-reinforced light weight alloy composite material according to claim 32 or 33, wherein the volume fraction of the reinforcing material is set at 30% or less.

35. A silicon carbide-reinforced light weight alloy composite material according to claim 1 or 2, wherein said light weight alloy is an aluminum alloy.

36. A silicon carbide-reinforced light weight alloy composite material according to claim 35, wherein said aluminum alloy is one selected from the group consisting of an Al-Cu based alloy containing 4% or less by weight of Cu, an Al-Mg based alloy containing 1% or less by weight of Mg, and an Al-Si based alloy containing 7% or less by weight of Si.

37. A silicon carbide-reinforced light weight alloy composite material according to claim 36, wherein said aluminum alloy comprises 4.0 to 7.0% by weight of Si, 2.0 to 4.0% by weight of Cu, 0.25 to 0.5% by weight of Mg and the balance of Al.

38. A silicon carbide-reinforced light weight alloy composite material according to claim 35, wherein said aluminum alloy is an Al-Si based alloy which is not subjected to an improving treatment.

39. A silicone carbide-reinforced light weight alloy composite material according to claim 35, wherein said aluminum alloy is an Al-Si base alloy subjected to an improving treatment effected by adding one element selected from the group consisting of Sb, Na and Sr, with the amount of Na added being set at less than 10 ppm, and the amount of Sr added being set at less than 0.03% by weight.

40. A silicon carbide-reinforced light alloy composite material according to claim 6, wherein said $SiO_2$ content is in a range of 0.25 to 2.0% by weight.

41. A silicon carbide-reinforced light alloy composite material according to claim 7, wherein said $SiO_2$ content is in a range of 0.25 to 2.0% by weight.

42. A silicon carbide-reinforced light alloy composite material according to claim 8, wherein said $SiO_2$ content is in a range of 0.25 to 2.0% by weight.

43. A silicon carbide-reinforced light weight alloy composite material comprising a matrix of a light weight alloy and a reinforcing material, said reinforcing material consisting of at least one of a silicon carbide whisker and a silicon carbide grain, wherein a content of $SiO_2$ contained in said reinforcing material is set in a range of 0.05 to 5.0% by weight, said composite material containing a substantially spherical aggregate formed of a material same as the reinforcing material, said aggregate having a volume fraction higher than the volume fraction of the reinforcing material, with a diameter of the aggregate being set at 100 μm or less, and a content of the aggregate base on said reinforcing material being set in a range of 0.2% to 5.0% by volume.

* * * * *